US008776544B2

(12) United States Patent
McCollough et al.

(10) Patent No.: US 8,776,544 B2
(45) Date of Patent: Jul. 15, 2014

(54) REFRIGERATION SYSTEM FOR REFRIGERATION APPLIANCE

(75) Inventors: Thomas W. McCollough, Anderson, SC (US); David R. Ducharme, Anderson, SC (US); Xiaoyong Fu, Greer, SC (US); Dennis Schenk, Anderson, SC (US)

(73) Assignee: Electrolux Home Products, Inc., Cleveland, OH (US)

( * ) Notice: Subject to any disclaimer, the term of this patent is extended or adjusted under 35 U.S.C. 154(b) by 805 days.

(21) Appl. No.: 12/712,730

(22) Filed: Feb. 25, 2010

(65) Prior Publication Data

US 2010/0218540 A1 Sep. 2, 2010

Related U.S. Application Data

(60) Provisional application No. 61/156,501, filed on Feb. 28, 2009.

(51) Int. Cl.
*F25D 3/02* (2006.01)
*F25C 5/18* (2006.01)

(52) U.S. Cl.
USPC ..... 62/420; 62/344

(58) Field of Classification Search
USPC ..... 62/344, 378, 420, 312, 425, 424, 457, 62/459
See application file for complete search history.

(56) References Cited

U.S. PATENT DOCUMENTS

| | | | | |
|---|---|---|---|---|
| 2,846,854 | A | 8/1958 | Galin | |
| RE26,101 | E * | 10/1966 | Nelson | 62/347 |
| 3,287,933 | A | 11/1966 | O'Connell et al. | |
| 3,630,046 | A * | 12/1971 | Boor | 62/408 |
| 3,835,661 | A | 9/1974 | Kochendorfer et al. | |
| 4,889,316 | A | 12/1989 | Donahue | |
| 5,056,334 | A * | 10/1991 | Hooper et al. | 62/320 |
| 5,065,584 | A | 11/1991 | Byczynski et al. | |
| 5,117,646 | A | 6/1992 | Nose et al. | |
| 5,357,769 | A | 10/1994 | Crabtree et al. | |
| 5,575,833 | A | 11/1996 | Griffin | |
| 5,715,703 | A | 2/1998 | Kopf et al. | |
| 5,755,113 | A | 5/1998 | Ferguson et al. | |
| 5,910,159 | A | 6/1999 | Matsuo et al. | |
| 6,058,734 | A | 5/2000 | Lee | |
| 6,185,948 | B1 | 2/2001 | Niki et al. | |

(Continued)

FOREIGN PATENT DOCUMENTS

| | | |
|---|---|---|
| DE | 29603848 | 5/1997 |
| WO | 9800678 | 1/1998 |

OTHER PUBLICATIONS

International Search Report for PCT/US2010/025582, dated Jul. 8, 2011, 2 pages.

*Primary Examiner* — Allana Lewin
*Assistant Examiner* — Dawit Muluneh
(74) *Attorney, Agent, or Firm* — Pearne & Gordon LLP

(57) ABSTRACT

Provided is a refrigeration appliance including a fresh food compartment for storing food items in a refrigerated environment having a target temperature above zero degrees Centigrade. A freezer compartment is disposed at an elevation vertically below the fresh food compartment for storing food items in a sub-freezing environment having a target temperature below zero degrees Centigrade. The refrigeration appliance also includes one or more of a hand-removable insulated cover, a cool air duct for introducing cooled air adjacent an ice bin, and a rearward-sloped catch pan positioned to catch dripping water in said ice maker and direct the dripping water into a drain.

8 Claims, 24 Drawing Sheets

(56) References Cited

U.S. PATENT DOCUMENTS

| | | | | |
|---|---|---|---|---|
| 6,370,908 | B1 | 4/2002 | James | |
| 6,393,852 | B2 | 5/2002 | Pham et al. | |
| 6,408,635 | B1 | 6/2002 | Pham et al. | |
| 6,438,974 | B1 | 8/2002 | Pham et al. | |
| 6,467,280 | B2 | 10/2002 | Pham et al. | |
| 6,474,094 | B2 | 11/2002 | Kim | |
| 6,499,305 | B2 | 12/2002 | Pham et al. | |
| 6,662,578 | B2 | 12/2003 | Pham et al. | |
| 6,662,583 | B2 | 12/2003 | Pham et al. | |
| 6,679,072 | B2 | 1/2004 | Pham et al. | |
| 6,681,596 | B2 | 1/2004 | Kentner et al. | |
| 6,735,947 | B1 | 5/2004 | Dormeier et al. | |
| 6,735,959 | B1 | 5/2004 | Najewicz | |
| 6,758,047 | B1 * | 7/2004 | Giles | 62/66 |
| 7,076,967 | B2 | 7/2006 | Lee et al. | |
| 7,121,109 | B2 | 10/2006 | Heims | |
| 7,159,406 | B2 | 1/2007 | Schuchart | |
| 7,237,395 | B2 | 7/2007 | Rafalovich et al. | |
| 7,389,649 | B2 | 6/2008 | Pham et al. | |
| 2005/0173323 | A1 * | 8/2005 | Meuleners et al. | 210/184 |
| 2006/0086130 | A1 * | 4/2006 | Anselmino et al. | 62/344 |
| 2006/0207282 | A1 * | 9/2006 | Visin et al. | 62/351 |
| 2006/0218961 | A1 * | 10/2006 | Kim et al. | 62/344 |
| 2006/0260346 | A1 | 11/2006 | Coulter et al. | |
| 2006/0266059 | A1 * | 11/2006 | Wetekamp et al. | 62/187 |
| 2007/0000271 | A1 | 1/2007 | Lee | |
| 2007/0163286 | A1 * | 7/2007 | Lim et al. | 62/389 |
| 2007/0180845 | A1 | 8/2007 | Castrellon | |
| 2007/0209382 | A1 * | 9/2007 | Kim et al. | 62/340 |
| 2008/0034779 | A1 * | 2/2008 | Lee et al. | 62/344 |
| 2008/0156000 | A1 * | 7/2008 | Shin et al. | 62/73 |
| 2008/0202141 | A1 | 8/2008 | Lim et al. | |
| 2008/0295539 | A1 * | 12/2008 | An et al. | 62/407 |
| 2009/0000882 | A1 | 1/2009 | Siebke | |
| 2009/0113924 | A1 | 5/2009 | Bae et al. | |
| 2009/0205356 | A1 * | 8/2009 | Collins et al. | 62/426 |
| 2010/0147002 | A1 | 6/2010 | Kim | |

* cited by examiner

FIG. 8B
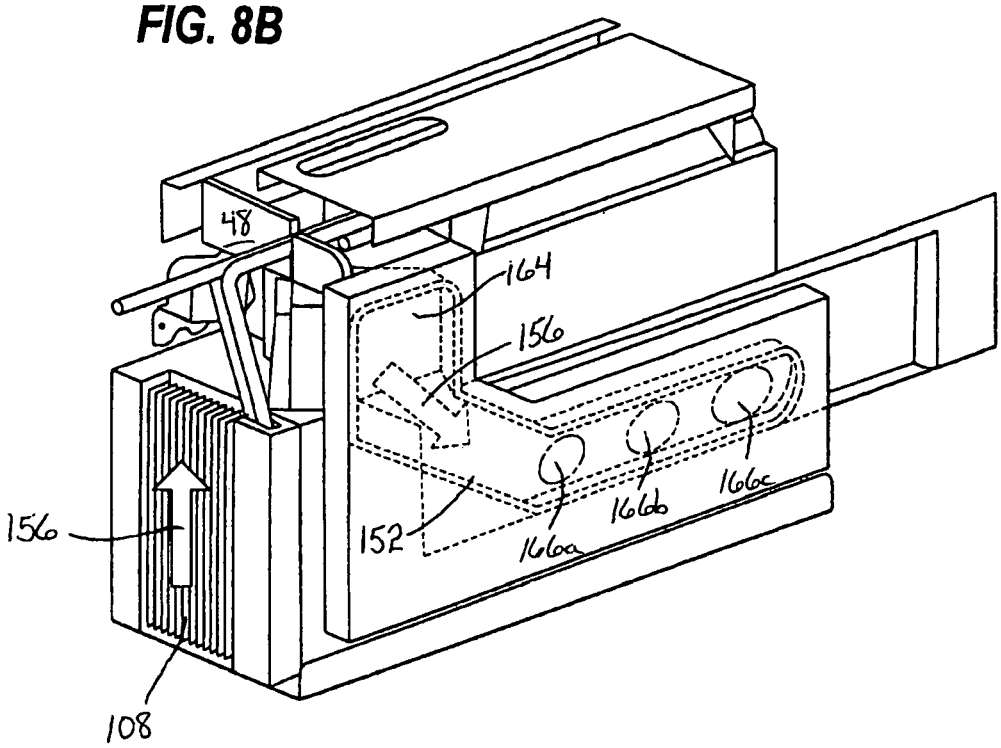
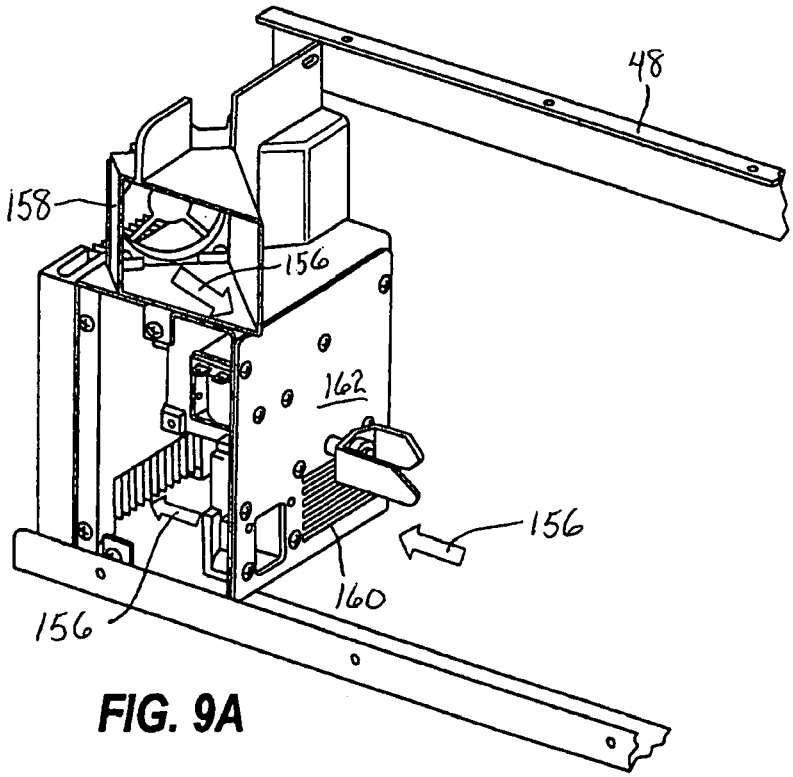
FIG. 9A

FIG. 15A
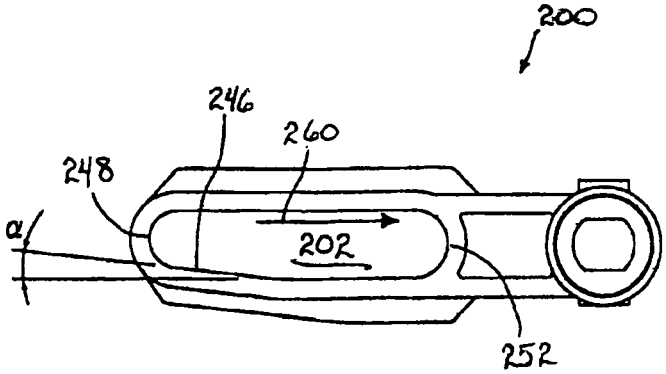
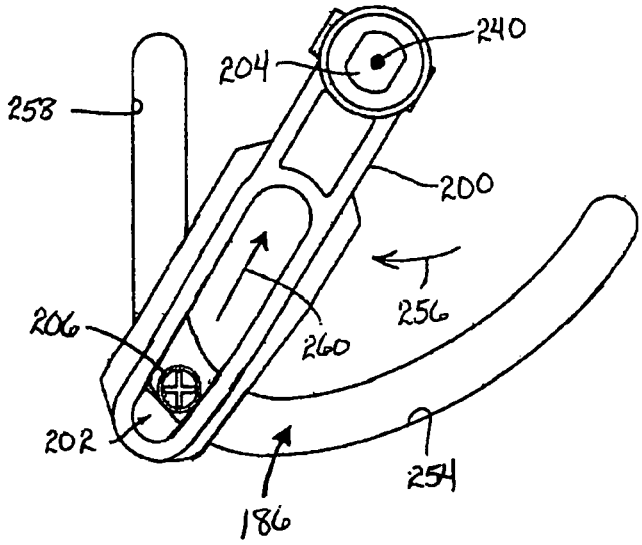
FIG. 15B

REFRIGERATION SYSTEM FOR REFRIGERATION APPLIANCE

CROSS-REFERENCE TO RELATED APPLICATIONS

This application claims the benefit of U.S. Provisional Application No. 61/156,501, filed Feb. 28, 2009, which is incorporated in its entirety herein by reference.

BACKGROUND OF THE INVENTION

1. Field of the Invention

This application relates generally to an ice making appliance, and more specifically to a refrigeration appliance including an ice maker disposed within a food-storage compartment of a refrigerator that is maintained at a temperature above a freezing temperature of water at atmospheric conditions, and a method of controlling the ice maker to produce ice.

2. Description of Related Art

Conventional refrigeration appliances, such as domestic refrigerators, typically have both a fresh food compartment and a freezer compartment or section. The fresh food compartment is where food items such as fruits, vegetables, and beverages are stored and the freezer compartment is where food items that are to be kept in a frozen condition are stored. The refrigerators are provided with a refrigeration system that maintains the fresh food compartment at temperatures above 0° C. and the freezer compartments at temperatures below 0° C.

The arrangements of the fresh food and freezer compartments with respect to one another in such refrigerators vary. For example, in some cases, the freezer compartment is located above the fresh food compartment and in other cases the freezer compartment is located below the fresh food compartment. Additionally, many modern refrigerators have their freezer compartments and fresh food compartments arranged in a side-by-side relationship. Whatever arrangement of the freezer compartment and the fresh food compartment is employed, typically, separate access doors are provided for the compartments so that either compartment may be accessed without exposing the other compartment to the ambient air.

Such conventional refrigerators are often provided with a unit for making ice pieces, commonly referred to as "ice cubes" despite the non-cubical shape of many such ice pieces. These ice making units normally are located in the freezer compartments of the refrigerators and manufacture ice by convection, i.e., by circulating cold air over water in an ice tray to freeze the water into ice cubes. Storage bins for storing the frozen ice pieces are also often provided adjacent to the ice making units. The ice pieces can be dispensed from the storage bins through a dispensing port in the door that closes the freezer to the ambient air. The dispensing of the ice usually occurs by means of an ice delivery mechanism that extends between the storage bin and the dispensing port in the freezer compartment door.

However, for refrigerators such as the so-called "bottom mount" refrigerator, which includes a freezer compartment disposed vertically beneath a fresh food compartment, placing the ice maker within the freezer compartment is impractical. Users would be required to retrieve frozen ice pieces from a location close to the floor on which the refrigerator is resting. And providing an ice dispenser located at a convenient height, such as on an access door to the fresh food compartment, would require an elaborate conveyor system to transport frozen ice pieces from the freezer compartment to the dispenser on the access door to the fresh food compartment. Thus, ice makers are commonly included in the fresh food compartment of bottom mount refrigerators, which creates many challenges in making and storing ice within a compartment that is typically maintained above the freezing temperature of water. Operation of such ice makers may be affected by temperature fluctuations and other events occurring within the fresh food compartments housing the ice makers, and prolonged exposure of the ice to the ambient environment of the fresh food compartment can result in partial melting of ice pieces. Further, assembly of such refrigerators can be complex and labor intensive due in part to the measures that must be taken to store ice pieces within the fresh food compartment.

Accordingly, there is a need in the art for a refrigerator including an ice maker disposed within a compartment of the refrigerator in which a temperature is maintained above 0° C. for a substantial period of time during which the refrigerator is operational.

BRIEF SUMMARY

According to one aspect, the subject application involves a refrigeration appliance including a fresh food compartment for storing food items in a refrigerated environment having a target temperature above zero degrees Centigrade, and a freezer compartment disposed vertically below the fresh food compartment for storing food items in a refrigerated environment having a target temperature below zero degrees Centigrade. The refrigeration appliance also includes a refrigeration system that is operable to provide a cooling effect to at least one of the fresh food compartment and the freezer compartment to maintain a temperature therein to within a suitable tolerance of the target temperature. An ice maker is disposed within the fresh food compartment for freezing water into ice pieces, and an insulated cover is releasably coupled adjacent to the ice maker to separate the ice maker from an interior of the fresh food compartment. The insulated cover includes a fastener that is compatible with a mating fastening member provided adjacent to the ice maker for removably coupling the insulated cover to the refrigeration appliance adjacent the ice maker.

According to another aspect, the subject application involves a refrigeration appliance including a fresh food compartment for storing food items in a refrigerated environment having a target temperature above zero degrees Centigrade, and a freezer compartment disposed at an elevation vertically below the fresh food compartment for storing food items in a sub-freezing environment having a target temperature below zero degrees Centigrade. An ice maker is disposed within the fresh food compartment for freezing water into ice pieces, and includes an ice bucket for storing the ice pieces produced by the ice maker. A cooling air duct includes at least a portion that extends along a length of the ice bucket for delivering air cooled to a temperature below zero degrees Centigrade by a refrigeration system provided to the refrigeration appliance to a region adjacent to the ice bucket.

According to another aspect, the subject application involves a refrigeration appliance including a fresh food compartment for storing food items in a refrigerated environment having a target temperature above zero degrees Centigrade, and a freezer compartment disposed at an elevation vertically below the fresh food compartment for storing food items in a sub-freezing environment having a target temperature below zero degrees Centigrade. An aperture is formed in a liner defining the fresh food compartment leading to a drain. An ice maker is disposed within the fresh food compartment for freezing water into ice pieces. The ice maker includes a catch pan disposed adjacent a bottom portion of the ice maker for catching water within the ice maker. The catch pan includes a sloped panel oriented to direct water collected by the catch pan generally toward the aperture and into the drain.

The above summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

BRIEF DESCRIPTION OF THE DRAWINGS

The invention may take physical form in certain parts and arrangement of parts, embodiments of which will be described in detail in this specification and illustrated in the accompanying drawings which form a part hereof and wherein:

FIG. 8B shows an illustrative embodiment of a portion of the ice maker in FIG. 8A;

FIG. 9A shows an exploded view of a portion of the ice maker shown in FIG. 8A;

FIG. 15A shows an embodiment of a drive arm to be provided to an ice making assembly for pivotally coupling a mold to an ice making assembly;

FIG. 15B shows another view of the drive arm shown in FIG. 15A driving a pin protruding from the mold along a track defined by an end bracket of the ice making assembly;

DETAILED DESCRIPTION

Figure 1:
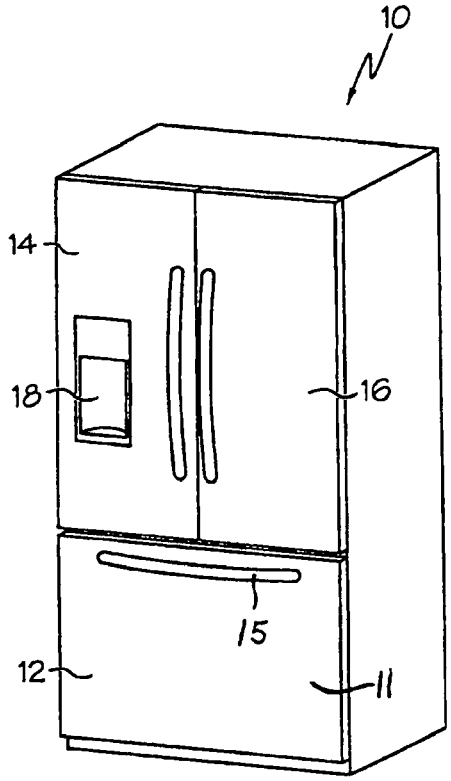
FIG. 1 shows a perspective view of an embodiment of a refrigerator including an ice maker disposed in a fresh food compartment.

Certain terminology is used herein for convenience only and is not to be taken as a limitation on the present invention. Relative language used herein is best understood with reference to the drawings, in which like numerals are used to identify like or similar items. Further, in the drawings, certain features may be shown in somewhat schematic form.

It is also to be noted that the phrase "at least one of", if used herein, followed by a plurality of members herein means one of the members, or a combination of more than one of the members. For example, the phrase "at least one of a first widget and a second widget" means in the present application: the first widget, the second widget, or the first widget and the second widget. Likewise, "at least one of a first widget, a second widget and a third widget" means in the present application: the first widget, the second widget, the third widget, the first widget and the second widget, the first widget and the third widget, the second widget and the third widget, or the first widget and the second widget and the third widget.

Referring to FIG. 1 there is illustrated a refrigeration appliance in the form of a domestic refrigerator, indicated generally at 10. Although the detailed description of an embodiment of the present invention that follows concerns a domestic refrigerator 10, the invention can be embodied by refrigeration appliances other than with a domestic refrigerator 10. Further, an embodiment is described in detail below, and shown in the figures as a bottom-mount configuration of a refrigerator 10, including a fresh-food compartment 14 disposed vertically above a freezer compartment 12. However, the refrigerator 10 can have any desired configuration including at least a fresh food compartment 14, an ice maker 20 (FIG. 2) and a refrigeration circuit 90 such as that described in detail below with reference to FIG. 7A without departing from the scope of the present invention. An example of such a domestic refrigerator is disclosed in application Ser. No. 11/331,732, filed on Jan. 13, 2006, which is incorporated in its entirety herein by reference.

One or more doors 16 shown in FIG. 1 are pivotally coupled to a cabinet 19 of the refrigerator 10 to restrict and grant access to the fresh food compartment 14. The door 16 can include a single door that spans the entire lateral distance across the entrance to the fresh food compartment 14, or can include a pair of French-type doors 16 as shown in FIG. 1 that collectively span the entire lateral distance of the entrance to the fresh food compartment 14 to enclose the fresh food compartment 14. For the latter configuration, a center mullion 21 (FIG. 2) is coupled to at least one of the doors 16 to establish a surface against which the doors 16 can seal the entrance to the fresh food compartment 14 at a location between opposing side surfaces 17 (FIG. 2) of the doors 16.

A dispenser 18 for dispensing at least ice pieces, and optionally water can be provided to one of the doors 16 that restricts access to the fresh food compartment 14 shown in FIG. 1. The dispenser 18 includes a lever, switch, proximity sensor or other device that a user can interact with to cause frozen ice pieces to be dispensed from an ice bin 35 (FIG. 2) provided to an ice maker 20 disposed within the fresh food compartment 14 through the door 16. Ice pieces from the ice bin 35 can be delivered to the dispenser via an ice chute 25, shown in FIG. 3, which extends at least partially through the door 16 between the dispenser 18 and the ice bin 35.

The ice chute 25 includes an aperture 30 (FIG. 2) through which ice pieces from the ice bin 35 fall into an interior passage 39 (shown as hidden lines in FIG. 3) defined by the ice chute 25 through insulation 37 provided to the door 16. To embed the ice chute 25 within the foam insulation 37 the ice chute 25 is to be aligned with an aperture 41 (FIG. 4) formed in a door liner 43 defining a recess that is to receive the dispenser 18. With the ice chute 25 so aligned the foam insulation 37 is injected in a fluid state in a space between the door liner 43 and an inner liner 47 establishing an interior surface of the door 16 exposed to the interior of the fresh food compartment 14. As the foam insulation 37 solidifies it secures the ice chute 25 in place within the door 16.

Figure 3:
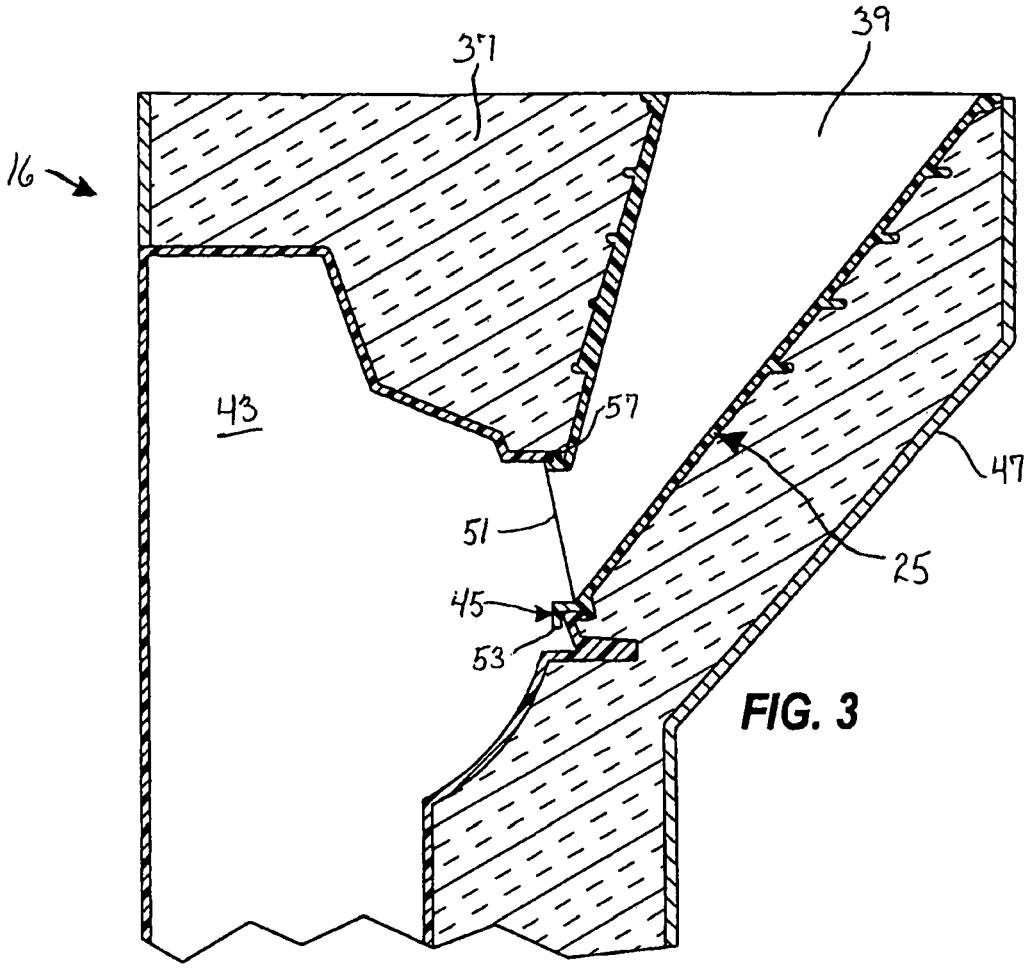
FIG. 3 shows a cutaway side view of a refrigerator door including an ice dispenser and an ice chute extending through the refrigerator door.
Figure 4:
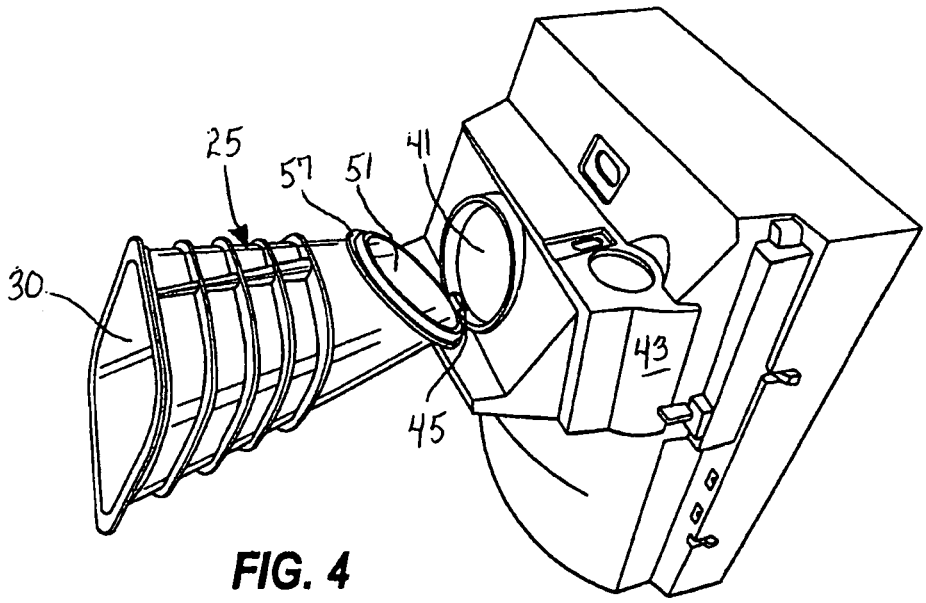
FIG. 4 shows a perspective view of the ice chute being assembled on a liner to be provided to the refrigerator door in FIG. 3.
Figure 5:
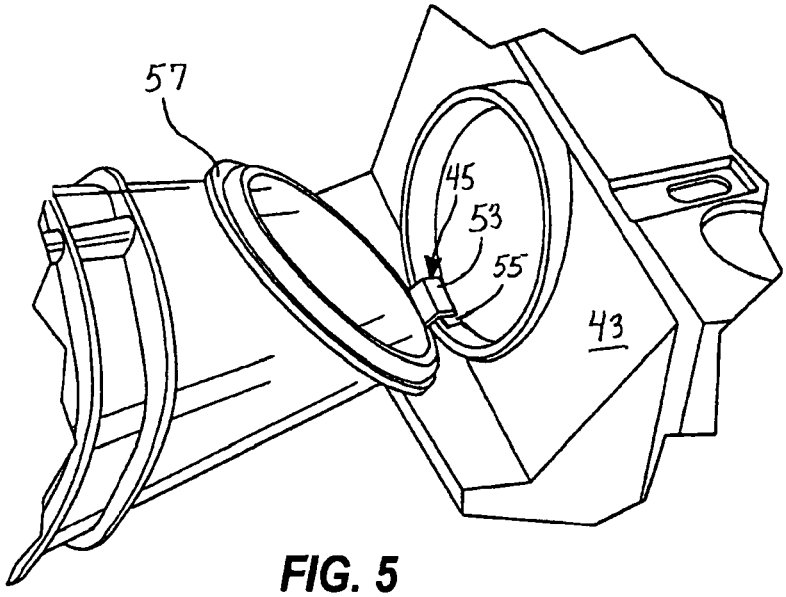
FIG. 5 shows a perspective view of cooperation between a tab protruding from the ice chute shown in FIG. 4 and the liner.

To ease assembly of the door 16 including the dispenser 18, the ice chute 25 can be partially aligned with the door liner 43 as shown in FIG. 4 prior to injection of the foam insulation 37. A fastener, which is shown as a male tab 45 projecting from a periphery of an outlet aperture 51 of the ice chute 25 in FIGS. 3-5, can be coupled to a portion of the door liner 43 to at least temporarily couple the ice chute 25 to the door liner 43 to minimize movement of the ice chute 25 relative to the door liner 43 during injection of the foam insulation 37. During assembly of the door 16, a flange portion 53 of the male tab 45 or other suitable fastener can be placed into a notch 55 (FIG. 5) or other compatible receiver formed in the door liner 43. With the flange portion 53 received within the notch 55 as shown in FIGS. 4 and 5, the ice chute 25 can be raised into position as shown in FIG. 3 such that the periphery of the outlet aperture 51 is at least partially received within the aperture 41 formed in the door liner 43. A flange 57 projecting in a radial direction away from the periphery of the outlet aperture 51 limits the extent to which the ice chute 25 can be inserted into the aperture 41 formed in the door liner 43. A gasket (not shown) can optionally be supported between the door liner 43 and the ice chute 25 when coupled together to minimize the leakage of moisture there between. With the ice chute 25 in the position shown in FIG. 3, the cooperation between the portions of the ice chute 25 and the portions of the door liner 43 establish a friction fit that can at least temporarily hold the ice chute 25 in place. The friction fit between the ice chute 25 and the door liner 43 minimizes movement of the ice chute 25 relative to the door liner 43 during installation of the foam insulation 37.

Although the ice chute 25 has been described as being held in place, at least temporarily by a friction fit, other embodiments can utilize a chemical or other suitable coupling to couple the ice chute 25 to the door liner 43. Further, the door liner 43 can alternately be provided with a male fastener component and the ice chute provided with the female receiver without departing from the scope of the invention. Regardless of the manner in which the ice chute 25 is coupled to the door liner 43, the foam insulation 37 can be installed without requiring an external support to hold the ice chute 25 in place to minimize movements of the ice chute 25 relative to the door liner 43 during installation of the foam insulation 37.

Referring once again to FIG. 1, the freezer compartment 12 is arranged vertically beneath the fresh food compartment 14. A drawer assembly (not shown) including one or more freezer baskets (not shown) can be withdrawn from the freezer compartment 12 to grant a user access to food items stored in the freezer compartment 12. The drawer assembly can be coupled to a freezer door 11 that includes a handle 15. When a user grasps the handle 15 and pulls the freezer door 11 open, at least one or more of the freezer baskets is caused to be at least partially withdrawn from the freezer compartment 12.

The freezer compartment 12 is used to freeze and/or maintain articles of food stored in the freezer compartment 12 in a frozen condition. For this purpose, the freezer compartment 12 is in thermal communication with a system evaporator 60 (FIG. 2) that removes thermal energy from the freezer compartment 12 to maintain the temperature therein at a temperature of 0° C. or less during operation of the refrigerator 10 in a manner described below.

The fresh food compartment 14 located in the upper portion of the refrigerator 10 in this example, serves to minimize spoiling of articles of food stored therein by maintaining the temperature in the fresh food compartment 14 during operation at a cool temperature that is typically less than an ambient temperature of the refrigerator 14, but somewhat above 0° C., so as not to freeze the articles of food in the fresh food compartment 14. According to some embodiments, cool air from which thermal energy has been removed by the system evaporator 60 can also be blown into the fresh food compartment 14 to maintain the temperature therein at a cool temperature that is greater than 0° C. For alternate embodiments, a separate evaporator can optionally be dedicated to separately maintaining the temperature within the fresh food compartment 14 independent of the freezer compartment 12. According to an embodiment, the temperature in the fresh food compartment can be maintained at a cool temperature that falls within a range between 0° C. and 4.5° C., including any subranges and any individual temperatures falling with that range. For example, other embodiments can optionally maintain the cool temperature within the fresh food compartment 14 within a reasonably close tolerance of a temperature between 0.25° C. and 4° C.

Figure 6:
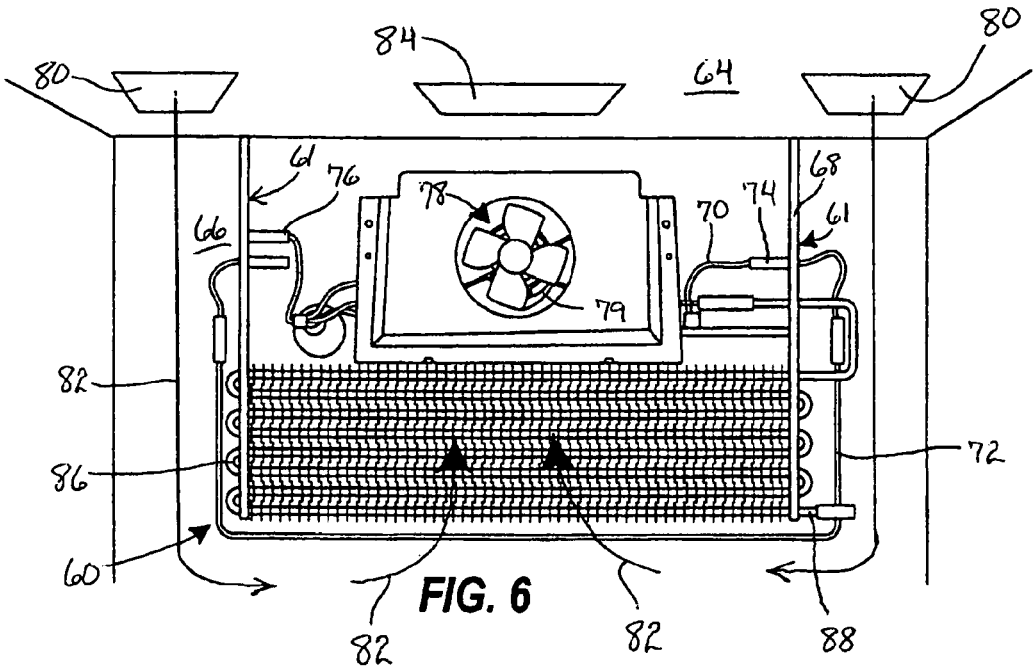
FIG. 6 shows a front view looking into a freezer compartment in which a system evaporator is disposed.

An embodiment of the system evaporator 60 for cooling air for both the freezer compartment 12 and the fresh food compartment 14 is shown in FIG. 6. The system evaporator 60 is supported within the freezer compartment 12 by a pair of laterally space brackets 61 which, in the present embodiment, are disposed adjacent to a ceiling portion 64 of a liner defining the freezer compartment 12 and a back wall 66 of the freezer compartment liner. A gasket 68 can optionally separate each bracket 61 from the portions of a liner and a cover (not shown) placed in front of the system evaporator 60 to conceal at least a portion of the system evaporator 60 from view when looking into the freezer compartment 12. Either or both of the brackets 61 can be coupled to the liner of the freezer compartment 12 by any suitable mechanical (e.g., screws, rivets, nuts and bolts, etc. . . . ), chemical (e.g., adhesive, epoxy, etc. . . . ) or other type of fastener.

At least one of the brackets 61 can optionally support a modular electrical connector 74 for connecting an electric heating element 72 for defrosting portions of the system evaporator 60 to a conductor 70 electrically connected to deliver to the heating element 72 electric power from a source (not shown) such as a conventional electric wall outlet. A second modular electrical connector 76 can optionally be supported by at least one of the brackets 61 in addition to, or instead of the modular electrical connector 74. The second modular electrical connector 76 can be used to electrically connect electronic components such as an electric fan 78 to a controller 111 (FIG. 7A) for conducting low-power control signals from the controller 111 to the electric fan 78 to control operation thereof. The second modular electrical connector 76 can, according to alternate embodiments, optionally also electrically connect the electric fan 78 to the source of electric power.

As shown in FIG. 6, the brackets 61 establish an impediment minimizing the portion of the airflow returning from the fresh food compartment 14 through return ducts 80 that can pass over the system evaporator 60 from a lateral side of the system evaporator 60. With the cover concealing the system evaporator 60 in place, the brackets 61 promote airflow returning through the return ducts 80 to travel along paths indicated by the arrows 82 in FIG. 6. An airflow passage 89 through which air returning via the return ducts 80 is defined by the back wall 66 of the freezer compartment liner, a side wall 69 of the freezer compartment liner, an air barrier surface of the bracket 61 supporting the system evaporator 60, and the cover when mounted forward of the system evaporator 60 and extending between the side walls 69 of the freezer compartment liner. By traveling along the paths indicated by the arrows 82, most of the airflow returning through the return ducts 80 will initially encounter the system evaporator 60 adjacent a bottommost portion of the primary heat-transfer region of the system evaporator 60 that is provided with a network of fins to maximize the surface area available for heat transfer between the brackets 61. Operation of the electric fan 78 draws the airflow upward over the fins and coils of the system evaporator 60, and then in a forward direction, generally parallel to the ceiling portion 64 of the freezer compartment 12 and toward a front of the freezer compartment 12. The generally horizontal orientation of the electric fan 78 allows at least a portion, optionally a motor 79 and/or fan blade, of the electric fan 78 to be positioned at a location other than vertically beneath a cool air duct 84 leading into the fresh food compartment 14. For example, the electric fan 78, or at least a portion thereof such as the motor 79, can be substantially aligned with the cool air duct 84 but disposed further into the depth of the freezer compartment 12 and optionally recessed within the back wall 66. A cover (not shown) positioned in front of the horizontally-oriented electric fan 78 redirects at least a portion of the horizontal airflow generally upward through a cool air duct 84 to be reintroduced into the fresh food compartment 14. Thus, the heat transfer surface area of the system evaporator 60 to which the airflow to be cooled by the system evaporator 60 is exposed is maximized.

Moisture from the airflow returning through the return ducts 80 can condense and freeze on portions of the system evaporator 60, causing frost to accumulate thereon. For instance, the ends 86 of the coils provided to the system evaporator 60 that are exposed laterally outside of the brackets 61 may be among the portions of the system evaporator 60 that accumulate frost. The heating element 72 can be activated as appropriate by the central controller provided to the refrigerator 10 to melt the frost. The heating element extends not only along the bottom of the system evaporator 60, but also extends around corners 88 of the system evaporator 60 to extend upwardly, substantially parallel with the series of ends 86 exposed beyond the brackets 61 to melt frost that has accumulated thereon. The heating element 72 can optionally extend along a substantial portion of the height of the system evaporator 60, and optionally even exceed the height of the system evaporator 60.

Figure 2:
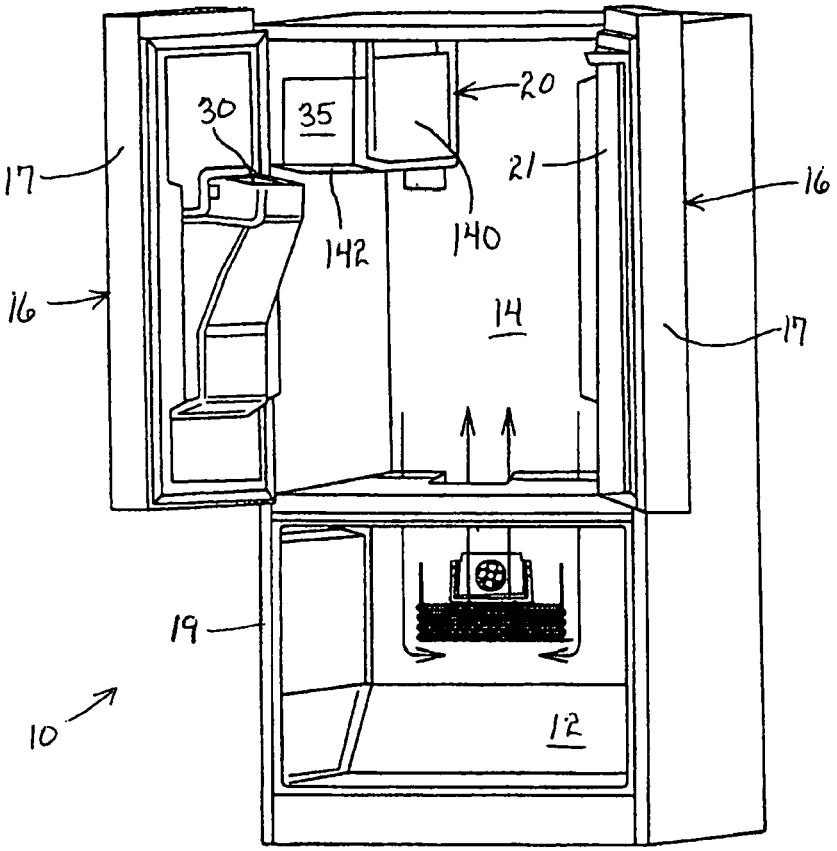
FIG. 2 shows a perspective view of an embodiment of a refrigerator including an ice maker disposed in a fresh food compartment with French doors restricting access into the fresh food compartment open.

The system evaporator 60 is included as part of a refrigeration circuit 90, shown in FIG. 7, provided to the refrigerator 10 for removing thermal energy from air to be used for controlling temperatures in at least one of the fresh food compartment 14 and the freezer compartment 12, and optionally for controlling a temperature of an ice maker evaporator 92 for freezing water into the ice pieces, and for controlling a temperature in the ice bin 35 provided to the ice maker 20. As shown, the refrigeration circuit 90 includes a variable-speed compressor 94 for compressing gaseous refrigerant to a high-pressure refrigerant gas. The compressor 94 can optionally be infinitely variable, or can be varied between a plurality of predetermined, discrete operational speeds depending on the demand for cooling. The high-pressure refrigerant gas from the compressor 94 can be conveyed through a suitable conduit such as a copper tube to a condenser 96, which cools the high-pressure refrigerant gas and causes it to at least partially condense into a liquid refrigerant. From the condenser 96, the liquid refrigerant can optionally be transported through an optional eliminator tube 98 that is embedded within a portion of the center mullion 21 (FIG. 2). The liquid refrigerant flowing through the eliminator tube 98 elevates the temperature of the external surface of the center mullion 21 to minimize the condensation of moisture from an ambient environment of the refrigerator 10 thereon.

According to alternate embodiments, the refrigerator 10 includes a humidity sensor for sensing a humidity of an ambient environment in which the refrigerator 10 is in use. The humidity sensor can optionally be placed at a location on the refrigerator 10 out of sight to users. For example, the humidity sensor can optionally be housed within a plastic cap covering a portion of a hinge assembly on top of the refrigerator 10. For such embodiments, the refrigerator 10 can also optionally include a valve or other flow controller for adjusting the flow of refrigerant through the eliminator tube 98 based at least in part on the sensed humidity. Controlling the flow of refrigerant through the eliminator tube 98 can minimize the condensation on the external surface of the center mullion 21 even in high-humidity environments.

Downstream of the eliminator tube 98, or downstream of the condenser 96 in the absence of the eliminator tube 98, a dryer 100 is installed to minimize the moisture content of the refrigerant within the refrigeration circuit 90. The dryer 100 includes a hygroscopic desiccant that removes water from the liquid refrigerant. Even though the water content of the refrigerant is minimized shortly after the refrigerant flows through the refrigeration circuit 90, once the refrigeration circuit 90 the dryer 100 remains in the refrigeration circuit 90 to avoid exposing the refrigerant to the ambient environment to avoid attracting additional moisture.

A system capillary tube 102 is in fluid communication with the dryer 100 to transport refrigerant to be delivered to the system evaporator 60. Likewise, an ice maker capillary tube 104 is also in fluid communication with the dryer 100. The ice maker capillary tube 104 transports refrigerant to be delivered to at least an ice maker evaporator 106 provided to the ice maker 20 for freezing water into the ice pieces, and optionally to a chamber evaporator 108 provided to the ice maker 20 for controlling a storage temperature to which ice pieces are exposed when stored in the ice bin 35.

An electronic expansion valve 110 is disposed between the ice maker evaporator and the dryer 100. The electronic expansion valve 110 is configured to control the flow of refrigerant entering the ice maker evaporator 106 and the optional chamber evaporator 108. The electronic expansion valve 110 allows the flow of refrigerant to the portion of the refrigeration circuit 90 including the ice maker evaporator 106 (this portion being referred to hereinafter as the "Ice Maker Path") independently of the portion of the refrigeration circuit 90 including the system evaporator 60 for controlling the temperature within at least one of the freezer compartment 12 and the fresh food compartment 14 (this portion being referred to hereinafter as the "System Path"). Thus, the flow of refrigerant to the ice maker evaporator 106, and optionally to the chamber evaporator 108 can be discontinued as appropriate during ice making as described in detail below even though the compressor 94 is operational and refrigerant is being delivered to the system evaporator 60.

Additionally, the opening and closing of the electronic expansion valve 110 can be controlled to regulate the temperature of at least one of the ice maker evaporator 106 and the chamber evaporator 108. A duty cycle of the electronic expansion valve 110, in addition to or in lieu of the operation of the compressor 94, can be adjusted to change the amount of refrigerant flowing through the ice maker evaporator 106 based on the demand for cooling. There is a greater demand for cooling by the ice maker evaporator 106 while water is being frozen to form the ice pieces than there is when the ice pieces are not being produced. The electronic expansion valve 110 can be located at a point before (i.e., upstream of) the ice maker evaporator 106 so the refrigerator 10 can operate at its desired state. In other words, the system evaporator 60 can be supplied with the refrigerant by the compressor 94 even when the ice maker is not making ice pieces. It is desirable to avoid changing the operation of the compressor 94 while the electronic expansion valve 110 is operational to account for the needs of the ice maker evaporator 106.

The steps taken to control operation of the refrigeration circuit 90 can optionally be executed by a controller 111 operatively connected to portions of the refrigeration circuit 90 to receive and/or transmit electronic signals to those portions. For example, temperature sensors discussed herein can optionally be wired to transmit signals indicative of sensed temperatures to the controller 111. In response, a microprocessor 112 provided to the controller 111 executing computer-executable instructions stored in a computer-readable memory 114 embedded in the microprocessor 112 can initiate transmission of an appropriate control signal from the controller 111 to cause and adjustment of the electronic expansion valve 110, compressor 94, or any other portion of the refrigeration circuit 90 to carry out the appropriate control operation.

A system heat exchanger 116 can be provided to exchange thermal energy between refrigerant being delivered to the system evaporator 60 from the dryer 100 and refrigerant being returned to the compressor from a common liquid accumulator 118 that is fed with returning refrigerant from both the Ice Maker Path and the System Path. The liquid accumulator 118 provides a storage reservoir that allows further expansion of any liquid refrigerant returning from the Ice Maker Path and the System Path, resulting in at least partial evaporation of the liquid refrigerant to the gaseous phase. The system heat exchanger 116 adds heats to the refrigerant returning to the compressor 94 from the liquid accumulator 118, further promoting the return of a gaseous phase refrigerant to the compressor 94 and minimizing the return of liquid refrigerant to the compressor 94.

Similarly, an ice maker heat exchanger 120 can be provided to exchange thermal energy between refrigerant being delivered to the Ice Maker Path from the dryer 100 and refrigerant being returned to the compressor from the Ice Maker Path before it reaches the liquid accumulator 118. The system evaporator 60 will generally operate at a lower temperature than the ice maker evaporator 106 and the chamber evaporator 108. To achieve the lower temperature, a greater amount of thermal energy is removed from the air being cooled by the system evaporator 60 than is removed from the ice maker evaporator 106 and the chamber evaporator 108. Thus, the refrigerant returning from the Ice Maker Path is more likely to be in a liquid phase upon its return to the liquid accumulator 118 than the refrigerant returning from the System Path. To promote the evaporation of returning liquid refrigerant from the Ice Maker Path the ice maker heat exchanger 120 facilitates the exchange of thermal energy from higher-temperature refrigerant from the dryer 100 to the relatively lower temperature refrigerant returning to the liquid accumulator 118. The thermal energy exchanged can optionally provide the latent heat of vaporization sufficient to at least partially evaporate the liquid refrigerant returning from the Ice Maker Path to the liquid accumulator 118.

Also due at least in part to the different operating temperatures of the system evaporator 60, ice maker evaporator 106, and chamber evaporator 108, the pressure drop experienced by the refrigerant across the Ice Maker Path, or at least the pressure of the refrigerant returning from the Ice Maker Path can be different than the corresponding pressures from the System Path. For example, the pressure of the refrigerant returning from the Ice Maker Path may be greater than the pressure of the refrigerant returning from the System Path at a point 122 where the refrigerant returning from each path is combined. To minimize the effect of the higher-pressure refrigerant returning from the Ice Maker Path on the performance of the system evaporator 60 (i.e., by increasing the output pressure from the system evaporator 60), an evaporator pressure regulator 124 disposed between the Ice Maker Path and the point 122 where the refrigerants returning from each path are combined. The evaporator pressure regulator 124 can adjust the pressure of the refrigerant returning from the Ice Maker Path to approximately match the pressure of the refrigerant returning from the System Path.

According to alternate embodiments, the evaporator pressure regulator 124 can be provided at another suitable location within the refrigeration circuit 90 to substantially isolate the operating pressure of refrigerant from the Ice Maker Path from the operating pressure of refrigerant from the System Path. For such alternate embodiments, the evaporator pressure regulator 124 can optionally raise or lower the pressure of referent from either or both of the Ice Maker Path and the System Path to minimize the impact of the refrigerant from one of the Paths on the refrigerant from the other of the Paths.

Figure 7A:
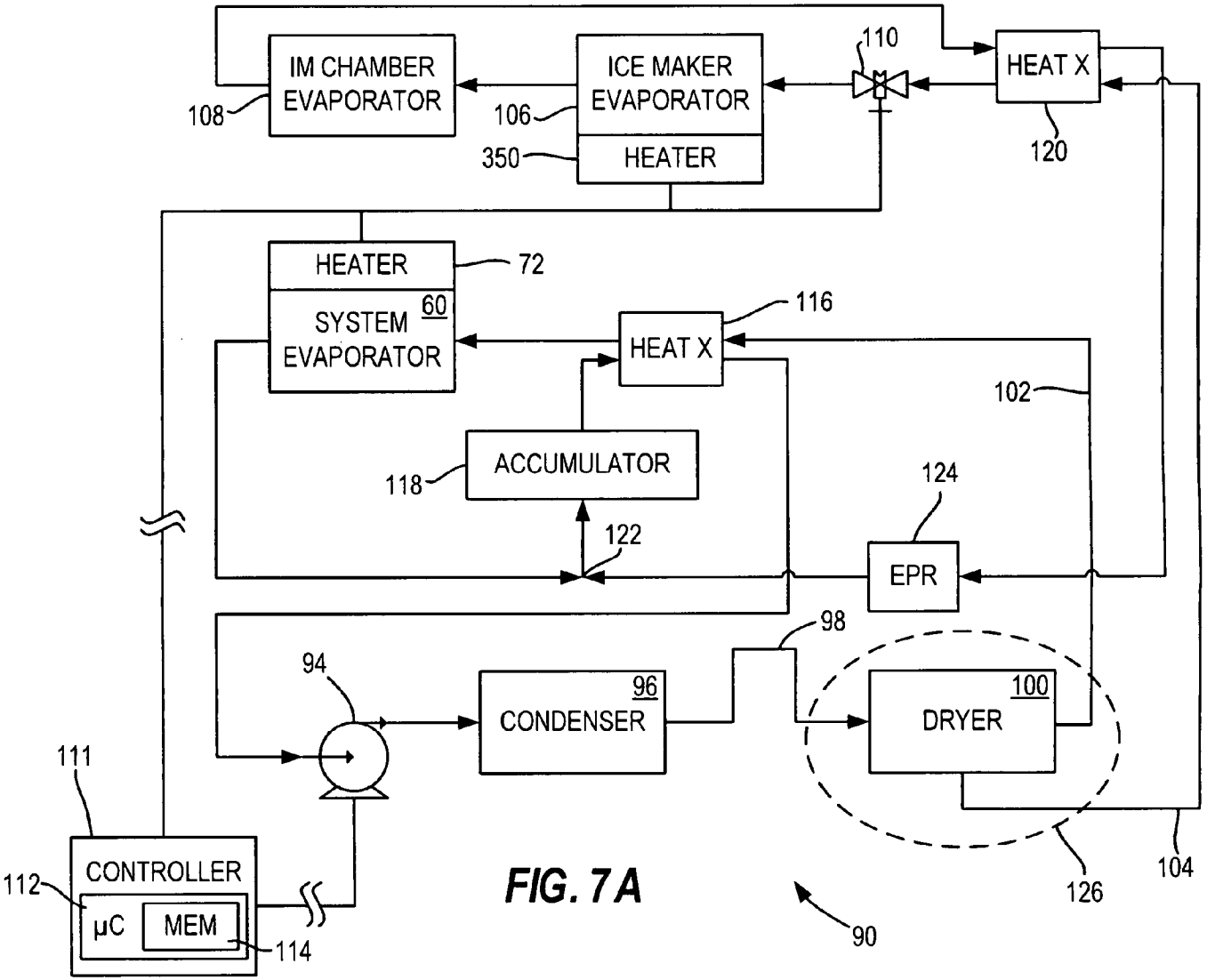
FIG. 7A shows an illustrative embodiment of a refrigeration circuit of a refrigerator.
Figure 7B:
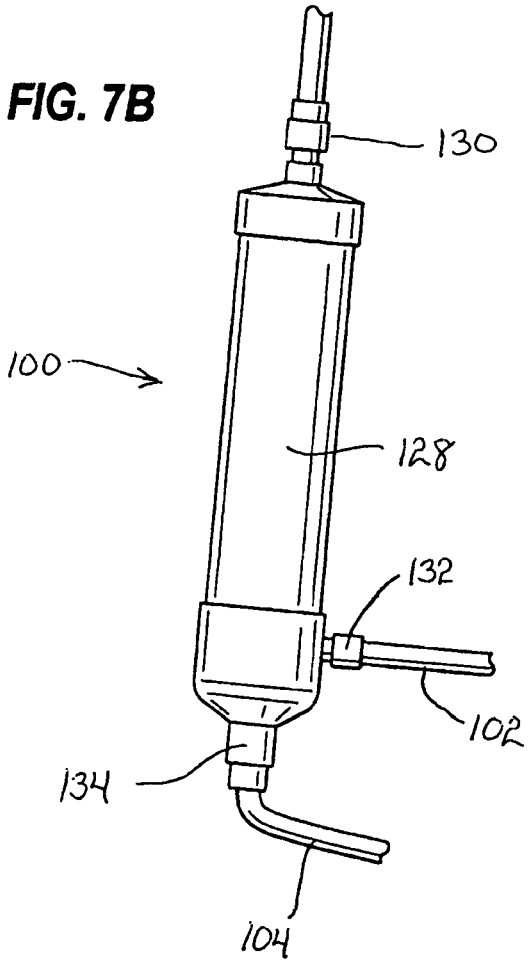
FIG. 7B shows an illustrative embodiment of an F-joint formed between a dryer and a pair of capillary tubes.

An embodiment of an arrangement of the system capillary tube 102 and the ice maker capillary tube 104 relative to the dryer 100 (the portion of the refrigeration circuit 90 within a circle 126 in FIG. 7A) is shown in FIG. 7B. As shown, the dryer 100 includes a substantially vertical and cylindrical body 128 including a refrigerant inlet 130 adjacent and upper portion of the body 128. A system outlet 132 is in fluid communication with the system capillary tube 102 for outputting refrigerant to the System Path. Similarly, an ice maker outlet 134 is in fluid communication with the ice maker capillary tube 104 for outputting refrigerant to the Ice Maker Path. Such a configuration of the system outlet 132 and the ice maker outlet 134 relative to the body 128 of the dryer 100 is referred to herein as an "F-joint" because the body 128, the system outlet 132 and the ice maker outlet 134 collectively form a structure having the general appearance of an upside down "F".

The F-joint configuration of the dryer 100 and the outlets 132, 134 in communication with their respective capillary tubes 102, 104 promotes a substantially equal preference of the refrigerant exiting the dryer 100 to be delivered to each of the System Path and the Ice Maker Path. With reference to FIG. 2, it can be seen that the system evaporator 60 is disposed vertically lower on the refrigerator 10 than the ice maker 20 in which the ice maker evaporator 106 is located. Due to the relative difference between the height of the system evaporator 60 and the ice maker evaporator 106 on the refrigerator 10, a lower pressure is required to supply refrigerant from the dryer 100 to the system evaporator 60 than is required to supply refrigerant from the dryer 100 to the ice maker evaporator 106 if the outlets 132, 134 were at approximately the same location, and all other factors being equal. Further, the system evaporator 60 typically operates at a lower temperature (i.e., lower energy level) than the ice maker evaporator 106 and the chamber evaporator 108. Thus, if the system outlet 132 and the ice maker outlet 134 were located at approximately the same location along the body 128 of the dryer 100 the refrigerant exiting the dryer 100 would exhibit a substantial preference for the System Path as the path of least resistance, and the Ice Maker Path would be supplied with relatively little refrigerant.

In contrast, according to the F-joint configuration the system outlet 132 is disposed at a location along the length of the body 128 of the dryer 100 between the refrigerant inlet 130 where the refrigerant is introduced to the dryer 100 and 80 ice maker outlet 134 where the refrigerant exits the dryer 100 to be delivered to the Ice Maker Path. For the embodiment shown in FIG. 7B the dryer 100 is arranged vertically such that the ice maker outlet 134 is provided adjacent to bottommost portion of the dryer 100. The system outlet 132 is located vertically above the ice maker outlet 134, to extend radially outward from a side of the body 128. Refrigerant can be discharged from the dryer 100 through the ice maker outlet 134 in a direction that is generally parallel with, and assisted by a force of gravity to generally balance the preference of refrigerant leaving the dryer 100 between the system outlet 132 and the ice maker outlet 134. However, according to alternate embodiments the dryer 100 can include any suitable shape and arrangement. It is sufficient if the system outlet 132 and the ice maker outlet 134 are provided at different locations on the dryer 100 to achieve a substantially balanced preference of the refrigerant to be discharged from both the system outlet 132 and the ice maker outlet 134.

In operation, the compressor 94 compresses the substantially-gaseous refrigerant to a high pressure, high-temperature refrigerant gas. As this refrigerant travels through the condenser 96 it cools and condenses into a high-pressure liquid refrigerant. The liquid refrigerant can then optionally flow through the eliminator tube 98 and into the dryer 100, which minimizes moisture entrained within the refrigerant. The liquid refrigerant exits the dryer 100 through two capillary tubes 102, 104 to be delivered to the System Path and the Ice Maker Path, respectively.

The refrigerant conveyed by the system capillary tube 102 transfers some of its thermal energy to refrigerant returning from the System Path via the system heat exchanger 116 and subsequently enters the system evaporator 60. In the system evaporator 60, the refrigerant expands and at least partially evaporates into a gas. During this phase change, the latent heat of vaporization is extracted from air being directed over fins and coils of the system evaporator 60, thereby cooling the air to be directed by the electric fan 78 into at least one of the freezer compartment 12 and the fresh food compartment 14. This cooled air brings the temperature within the respective compartment to within an acceptable tolerance of a target temperature. From the system evaporator 60, the substantially gaseous refrigerant is returned to the liquid accumulator 118 where remaining liquid is allowed to evaporate into gaseous refrigerant. The substantially gaseous refrigerant from the liquid accumulator 118 can receive thermal energy from the refrigerant being delivered to the system evaporator 60 via the system heat exchanger 116 and then returned substantially in the gaseous phase to the compressor 94.

When ice is to be produced by the ice maker 20, the controller 111 can at least partially open the electronic expansion valve 110. Refrigerant from the dryer 100 delivered to the Ice Maker Path through capillary tube 104 provides thermal energy via ice maker heat exchanger 120 to the refrigerant returning from the Ice Maker Path. After passing through the electronic expansion valve 110 the refrigerant enters the ice maker evaporator 106 where it expands and at least partially evaporates into a gas. The latent heat of vaporization required to accomplish the phase change is drawn from the ambient environment of the icemaker evaporator 106, thereby lowering the temperature of an external surface of the icemaker evaporator 106 to a temperature that is below 0° C. Water exposed to the external surface of the ice maker evaporator 106 is frozen to form the ice pieces. The refrigerant exiting the ice maker evaporator 106 enters chamber evaporator 108, where it further expands and additional liquid refrigerant is evaporated into a gas to cool the external surface of the chamber evaporator 108. An optional fan or other air mover can direct an airflow over the chamber evaporator 108 to cool the ambient environment of ice pieces stored in the ice bin 35 to minimize melting of those ice pieces.

An illustrative embodiment of the ice maker 20 disposed within the fresh food compartment 14 of the refrigerator 10 is shown in FIG. 2. The ice maker 20 can be secured within the fresh food compartment using any suitable fastener, and includes a removable cover 140 for providing thermal insulation between the fresh food compartment 14 and the interior of the ice maker 20. The cover 140 can optionally be removably secured in place on the ice maker 20 by releasable mechanical fasteners such as screws, nuts and bolts, or any suitable friction fitting possibly including a system of tabs allowing removal of the cover 140 from the ice maker 20 by hand and without tools. Further, the cover 140 can include a substantially planar partition that can be removably coupled to a lateral side of the ice maker 20, can have a generally "L" shaped appearance when viewed on end so as to enclose a lateral side and bottom portion of the ice maker 20 when installed, can have a generally "U" shaped appearance when viewed on end so as to enclose both lateral sides and the bottom portion of the ice maker 20 when installed, or any other desired shape.

The ice bin 35 can also optionally be removably installed in the ice maker 20 to grant access to ice pieces stored therein. An aperture 142 formed along a bottom surface of the ice bin 35 is aligned with the aperture 30 leading into the ice chute 25 when the door 16 including the dispenser 18 is closed and allows for frozen ice pieces stored therein to be conveyed to the ice chute 25 and dispensed by the dispenser 18. A rotatable augur 144 (FIG. 8A) shown extended along a length of the ice bin 35 can optionally be provided to be rotated and urge ice towards the aperture 142 formed along the bottom surface adjacent a front portion of the ice bin 35 to be transported to the ice chute 25 and dispenser 18. The augur 144 can optionally be automatically activated and rotated by an electric motor in response to a request for ice pieces initiated by the user at the dispenser 18.

Figure 8A:
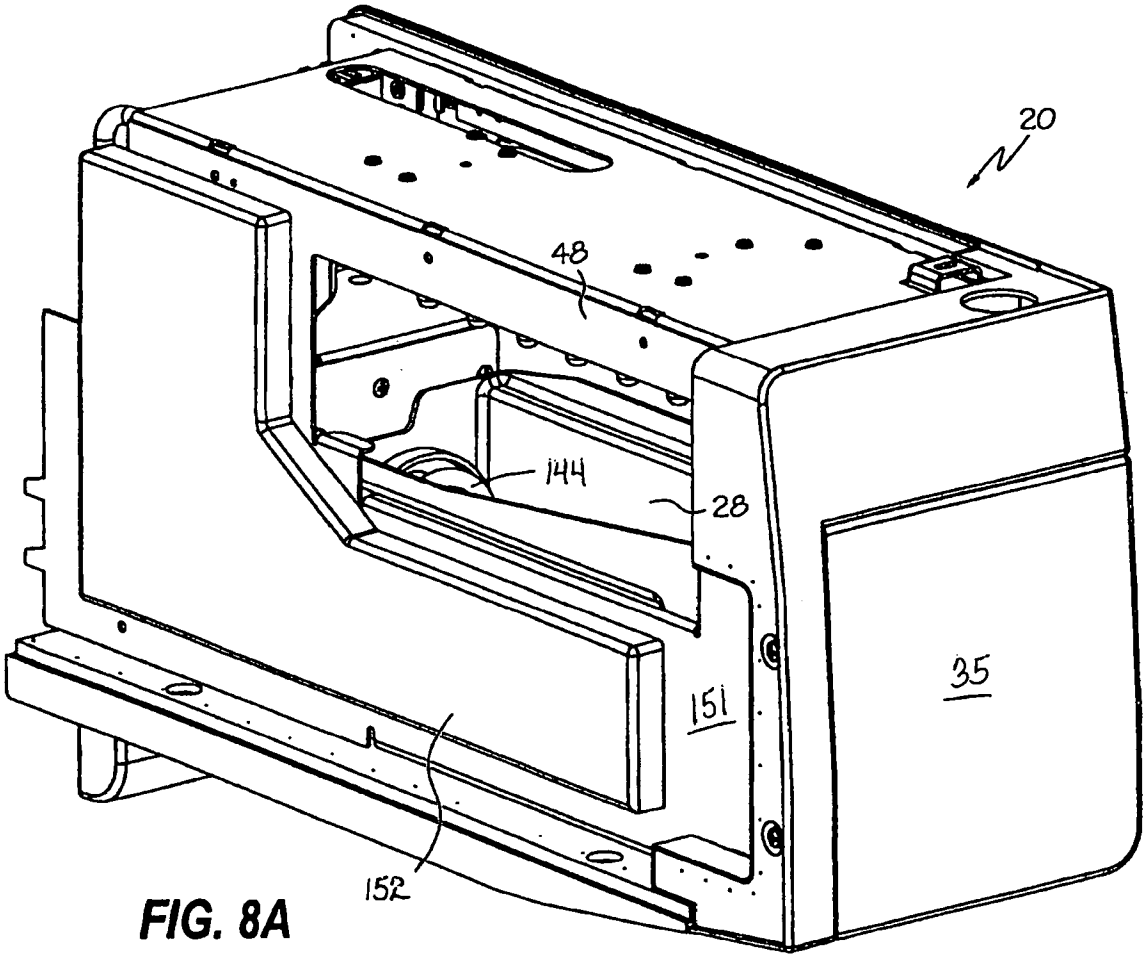
FIG. 8A shows an illustrative embodiment of an ice maker to be installed in a fresh food compartment of a refrigerator.

A perspective view of the ice maker 20 removed from the interior of the fresh food compartment 14 is shown in FIG. 8A. As shown the ice maker 20 includes a generally rectangular frame 48 defining an ice making chamber 28 in which an ice making assembly 180 (FIGS. 10-12) is disposed. The frame 48 is equipped with a plurality of receivers compatible with the fasteners used to secure the ice maker 20 within the fresh food compartment 14 of the refrigerator 10. The ice bin 35 and the removable cover 140 can be selectively removed from and secured to the frame 48 as desired. Although the cover 140 provides a degree of insulation between the ice making chamber 28 of the ice maker 20 and the fresh food compartment 14, its removable nature may prevent a hermetic seal from being formed between the ice making chamber 28 and fresh the food compartment 14. In other words, the cover 140 can optionally allow minimal amounts of thermal energy transfer to occur between the ice making chamber 28 of the ice maker 20 and the fresh food compartment 14. A cool air duct 152 is also coupled to the frame 48 to transport air cooled by the chamber evaporator 108 (FIG. 8B) to the ice bin 35 to minimize melting of ice pieces stored therein. The cool air duct 152 can optionally define an internal passage between the cool air duct 152 and a side panel 151 of the ice maker 20 through which cool air can travel to be introduced adjacent the ice bin 35 within the ice making chamber 28.

Figure 9B:
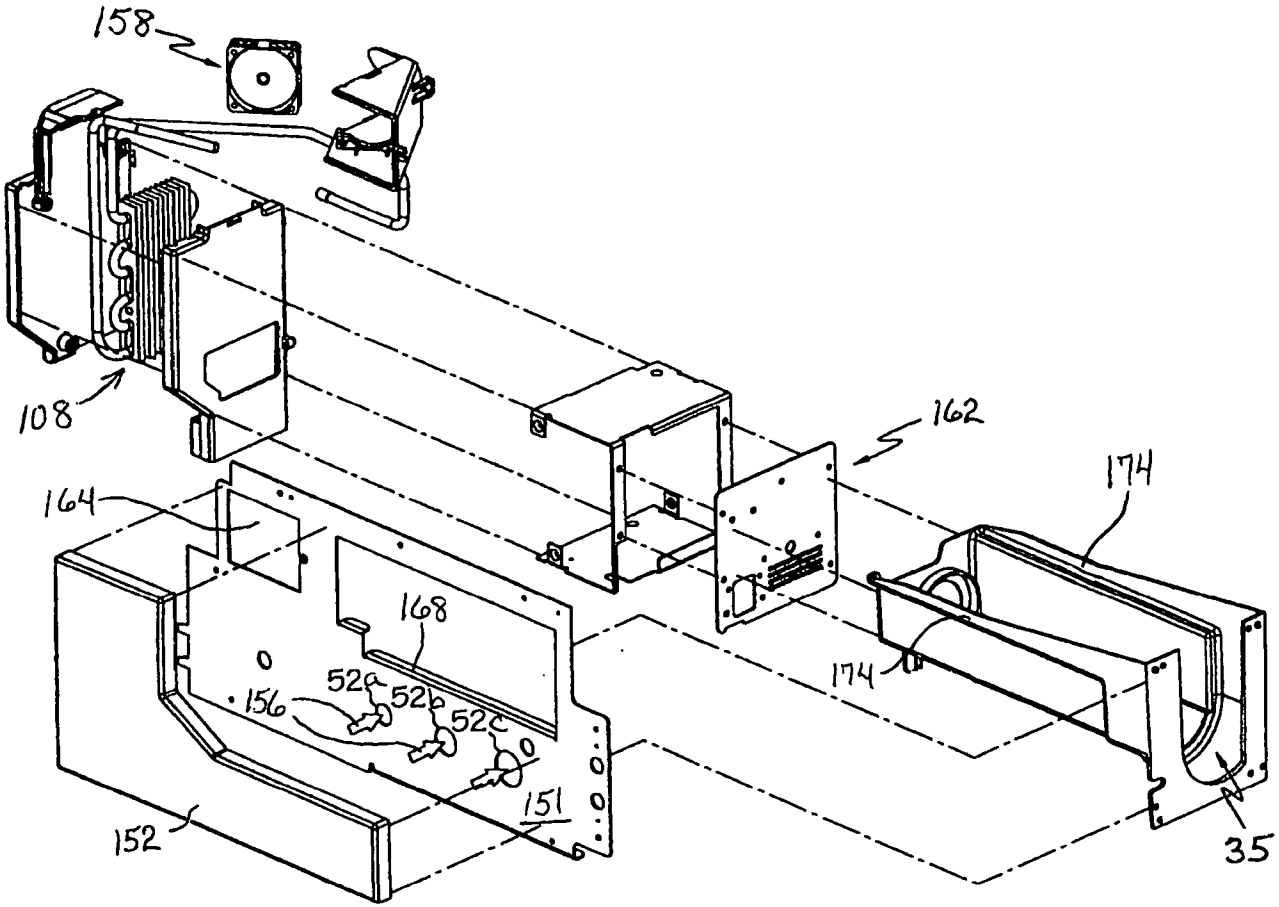
FIG. 9B shows an exploded view of a portion of the ice maker shown in FIG. 8B.

A partially cutaway view of a portion of the ice maker 20 is shown in FIG. 9A to illustrate an airflow pattern within the ice maker 20 to minimize melting of ice pieces in the ice bin 35. Air flowing in the direction indicated by arrows 156 can be directed over the chamber evaporator 108 (FIG. 8B) by a fan 158 (FIG. 9A) or other suitable air circulator. The air from within the ice making chamber 28 is drawn through a grate 160 formed in an interior partition 162 and drawn upwardly over the fins and tubes of the chamber evaporator 108. The fan 158 directs the cool air from which the thermal energy was removed by the chamber evaporator 108 through a window 164 leading into the cool air duct 152. The cool air from the cool air duct 152 is introduced adjacent a lateral side of the ice bin 35 within the ice making chamber 28 through a network of apertures 166*a*, 166*b*, 166*c* formed in the side panel 151. The diameter of each aperture 166*a*, 166*b*, 166*c* is progressively larger the further the apertures 166*a*, 166*b*, 166*c* are from the window 164 through which the cool air was introduced into the cool air duct 152. Thus, in FIG. 8B, the diameter of aperture 166*c* is greater than the diameter of aperture 166*a*. The increasing diameter of the apertures 166*a*, 166*b*, 166*c* promotes a substantially-even amount of cool air flowing through each of the apertures 166*a*, 166*b*, 166*c* to provide substantially uniform cooling along a length of the ice bin 35.

Cool air introduced into the ice making chamber 28 through the apertures 166*a*, 166*b*, 166*c* remains relatively close to the bottom of the ice making chamber 28 compared to warmer air. This cool air remains relatively close to the bottom of the ice making chamber 28 due at least in part to the airflow established by the fan 158. Thus, the temperature adjacent the bottom surface of the ice making chamber 28 can be maintained at a lower temperature than other locations within the ice making chamber 28 to keep the ice pieces within the ice bin 35 frozen. An example of another location within the ice making chamber 28 that can exceed 0° C. includes adjacent an upper portion of the ice making chamber 28 near the ice making assembly 180, or portions thereof, which is supported above the ice bin 35 within the ice making chamber 28.

The side panel 151 also includes an inward extending flange 168 forming a surface on which the ice bin 35 can rest within the ice making chamber 28. An opposing side panel 170, shown in FIG. 10A, partially encloses the other lateral side of the ice making chamber 28 of the ice maker 20 and includes a similar inward extending flange 172. The flanges 168, 172 provided to each of the side panels 151, 170 extend substantially along the length of the ice making chamber 28. The ice bin 35 shown in the exploded view of FIG. 9B includes a pair of compatible flanges 174 extending outwardly from upper portions of the lateral sides of the ice bin 35. The outwardly-extending flanges 174 of the ice bin 35 rest on top of the inwardly-extending flanges 168, 172 provided to the side panels 151, 170 of the ice maker frame 48 when the ice bin 35 is supported within the ice maker 20. The cooperation between the flanges provided to the ice bin 35 and side panels 151, 170 allows the ice bin 35 to be slidably removed from the ice maker 20.

Figure 10A:
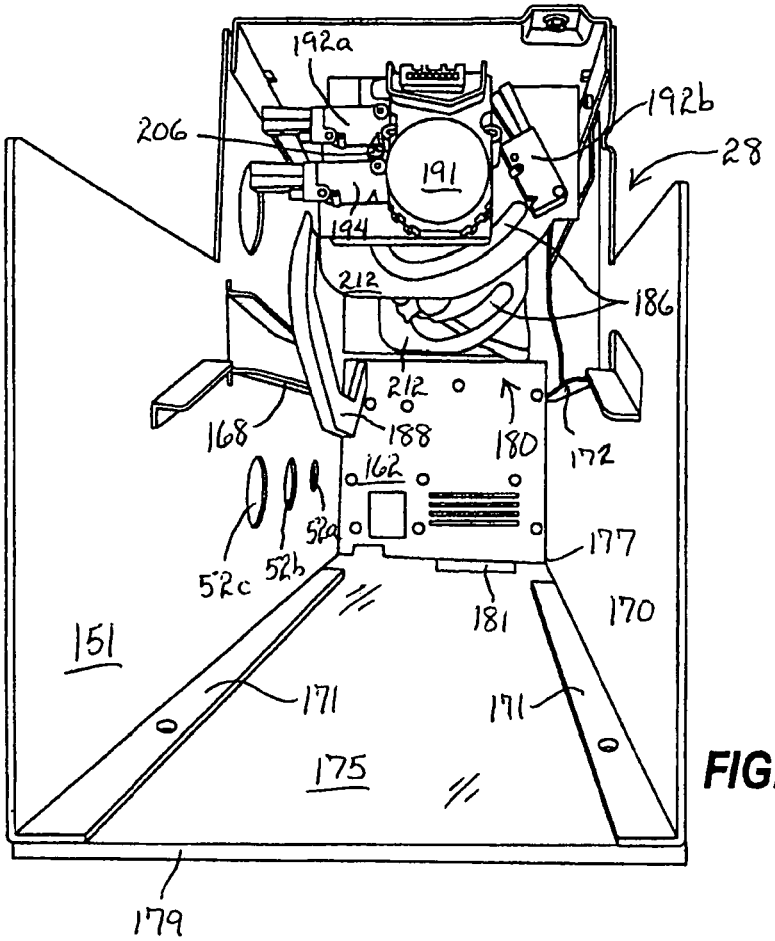
FIG. 10A shows a front view looking into an ice making chamber of an ice maker.

FIG. 10A also illustrates an embodiment of an ice making assembly 180 for freezing water into the ice pieces. The ice making assembly 180 is shown supported adjacent to a ceiling within the ice making chamber 28. The ice making assembly 180 includes a mold 182 (FIG. 12) for storing water to be frozen into the ice pieces, the ice maker evaporator 184 (FIGS. 11-13), a track 186 for guiding the mold 182 between a water-fill position and an ice-making position, a bail arm 188 for sensing the presence of ice pieces within the ice bin 35, and a driver 190, which includes an electric motor 191, for example, for driving the mold 182 between the water-fill position and the ice-making position. A plurality of switches 192*a*, 192*b* can also be provided to the ice making assembly 180 to determine when the mold 182 has reached a travel limit. The bail arm 188 can actuate another switch 194 to signify an upper limit and/or absence of ice pieces in the ice bin 35.

A floor panel 175 can be coupled between floor flanges 171 extending inward from the side panels 151, 170. Fasteners such as screws, bolts, rivets, etc. . . . can be inserted through the floor panel 175 and the flanges 171 to secure the floor panel 175 in place. The floor panel 175 is disposed vertically below the ice bin 35 on the ice maker 20, and is sloped rearward such that a vertical elevation of the rear portion 177 of the floor panel 175 is lower than a front portion 179 of the floor panel 175. Melted ice or water spilled within the ice maker 20 will be caught by the floor panel 175. The slope of the floor panel 175 will urge the water so caught toward the rear portion 177 of the floor panel 175 from where the water can be fed into a drain 181 adjacent to the rear portion 177 of the floor panel 175. The drain 181 can be concealed behind the interior partition 162 of the ice making chamber 28, and can optionally also be used to drain water from frost melted from the chamber evaporator 108 produced during a defrost cycle as described below. Water from the drain 181 can travel through a conduit concealed from view behind the liner of the freezer and fresh food compartments 12, 14 to reach a drain pan (not shown) provided to the refrigerator 10 for catching excess water, from where the water can be evaporated to the ambient environment of the refrigerator 10.

The discrete switches 192*a*, 192*b* in the embodiment shown in FIG. 10A are disposed at known locations adjacent opposite ends of the track 186 formed in at least one of the opposing brackets 212 at opposite ends of the mold 182. The switches 192*a*, 192*b* mark the travel limits of the mold 182 along the track 186. When one of the switches 192*a*, 192*b* is actuated while the mold is traveling along the track 186, that switch transmits a signal to the controller 111 to inform the controller 111 that the mold 182 is located at a know position within its range of travel.

For instance, during operation the position of the mold 182 along the path can be monitored and determined based on an operational parameter of the motor 191 driving the mold 182 between water-fill and ice making positions, or based on time of operation of the motor 191. For example, a Hall effect sensor can be operatively coupled to the motor 191 and the controller 111 (FIG. 7A) to transmit signals to the controller 111 based on revolutions of a rotor provided to the motor 191 to enable the controller 111 to calculate the position of the mold 182 at any given time. If an unexpected condition occurs such a malfunction of the Hall effect sensor, obstruction of the mold 182, loss of electric power while the mold 182 is traveling, or other such condition, however, the position of the mold 182 may not correspond directly to the calculation performed by the controller 111 based on the signal from the Hall effect sensor. Under such conditions, a signal will be sent by one of the switches 192*a*, 192*b* upon contact between that switch and a pin 206 extending from the mold 182 (or other portion of the mold 182) that is traveling along the track 186 as described below. Signals from the switches 192*a*, 192*b* can also optionally be used to calibrate the position of the mold 182 occasionally, such as at periodic intervals or every transition of the mold 182 between the water-fill and ice making positions. Other embodiments can include a timing circuit for timing operation of the motor 191 to determine the position of the mold 182 instead of, or in addition to the motor sensor.

Figure 10B:
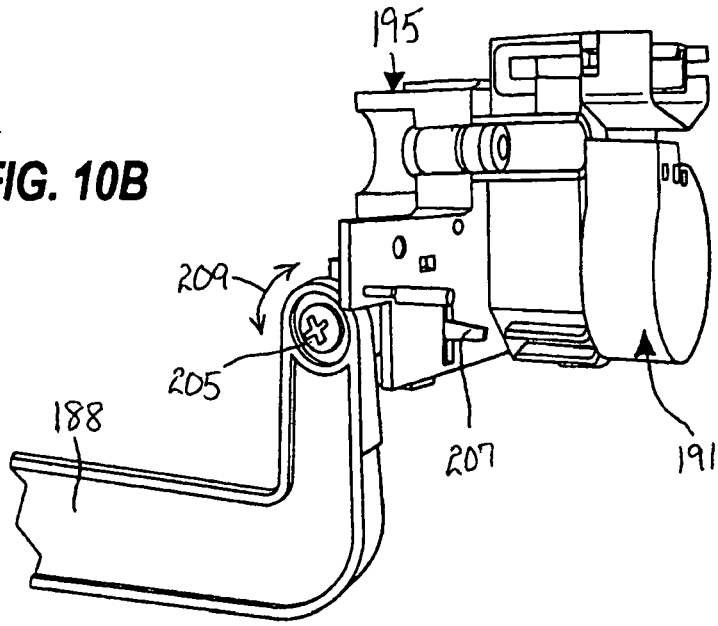
FIG. 10B shows an illustrative embodiment of a driver for adjusting a position of a mold between a water-fill position and an ice-making position.
Figure 10C:
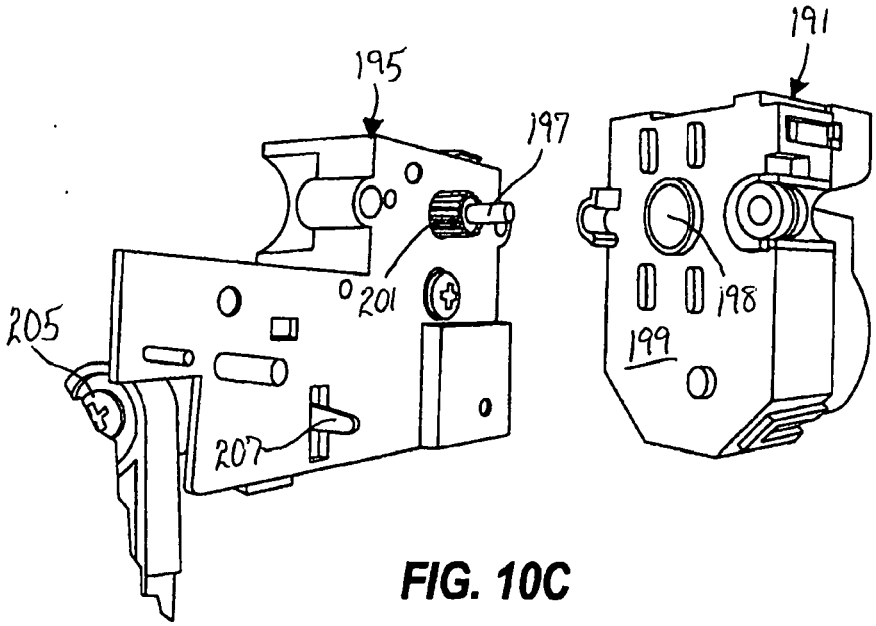
FIG. 10C shows a partial exploded view of the driver shown in FIG. 10B, wherein a motor has been separated from a drivetrain.

In addition to the motor 191, an embodiment of the driver 190 also includes a drive train 195 as shown in FIGS. 10B and 10C to operatively connect the bail arm 188 to the motor 191. The drive train 195 includes a network of gears (not shown) that transmit the rotational force of the motor 191 to the bail arm 188 to raise and lower the bail arm 188 during movement of the mold 182 between the water-fill and ice making positions. The input shaft 197 shown in the exploded view of FIG. 10C is received within an aperture 198 formed in the motor housing 199 where external teeth 201 provided to the input shaft 197 Thus, a single motor 191 can drive both the mold 182 and the bail arm 188 in the same motion.

For example, when ice pieces are harvested as described in greater detail below, the mold 182 is moved by the motor 191 away from the ice-making position back toward the water-fill position to allow the ice pieces to drop into the ice bin 35. The bail arm 188 serves to detect the height of ice pieces within the ice bin 35 by contacting the ice pieces when lowered therein. A lever 207 provided to the drive train 195 is operatively coupled to be adjusted based on an angular position of the bail arm 188 about a pivot point 205 in the directions indicated by arrow 209. If the bail arm 188 is permitted to be lowered to the full extent of its range of motion into the ice bin 35, the lever 207 is fully raised to its uppermost position to engage the switch 194 (FIG. 10A). Engagement of the switch can result in a signal transmission (or absence of a signal transmission) to the controller 11 indicating that there is room in the ice bin 35 for more ice pieces, and that automatic ice making operations are to continue.

When the path the bail arm 188 is to travel to its lowermost position into the ice bin 35 is obstructed by ice pieces therein, the bail arm 188 is not permitted to be lowered the full extent of its range of motion. If the bail arm 188 is prevented from being lowered to a predetermined level into the ice bin 35, the lever 207 will no longer engage the switch 194 when the bail arm 188 comes to a stop. Again, this can result in a signal transmission (or absence of a signal transmission) to the controller 11 indicating that the ice bin 35 is full, and that there is no more room in the ice bin 35 for additional ice pieces, and that automatic ice making operations are to be discontinued.

When enough ice pieces are removed from the ice bin 35 to allow the bail arm 188 to drop below the predetermined level within the ice bin 35 the lever 207 can once again engage the switch 194 to signal that ice making operations are to commence.

According to alternate embodiments, the motor 191 can optionally drive both the drive shaft 204 and bail arm 188 without the drive train 195. According to such embodiments the bail arm 188 is positioned along a path that the pin 206 travels while transitioning from the ice-making position to the water-fill position. When the pin 206 makes contact with the bail arm 188, or an object coupled to the bail arm 188, the contact between the bail arm 188 and pin 206 causes the bail arm 188 to be elevated to permit the ice pieces to fall into the ice bin 35. After the mold 182 has been refilled with water and is traveling back towards the ice-making position the motion of the pin 206 allows the bail arm 188 to be lowered into the ice bin 15. Just as before, if the ice pieces in the ice bin 35 are stacked high enough to prevent the bail arm 188 from being lowered beyond a predetermined extent into the ice bin 35, a signal can be transmitted to the controller 111 to indicate that ice making operations can be discontinued.

Figure 11:
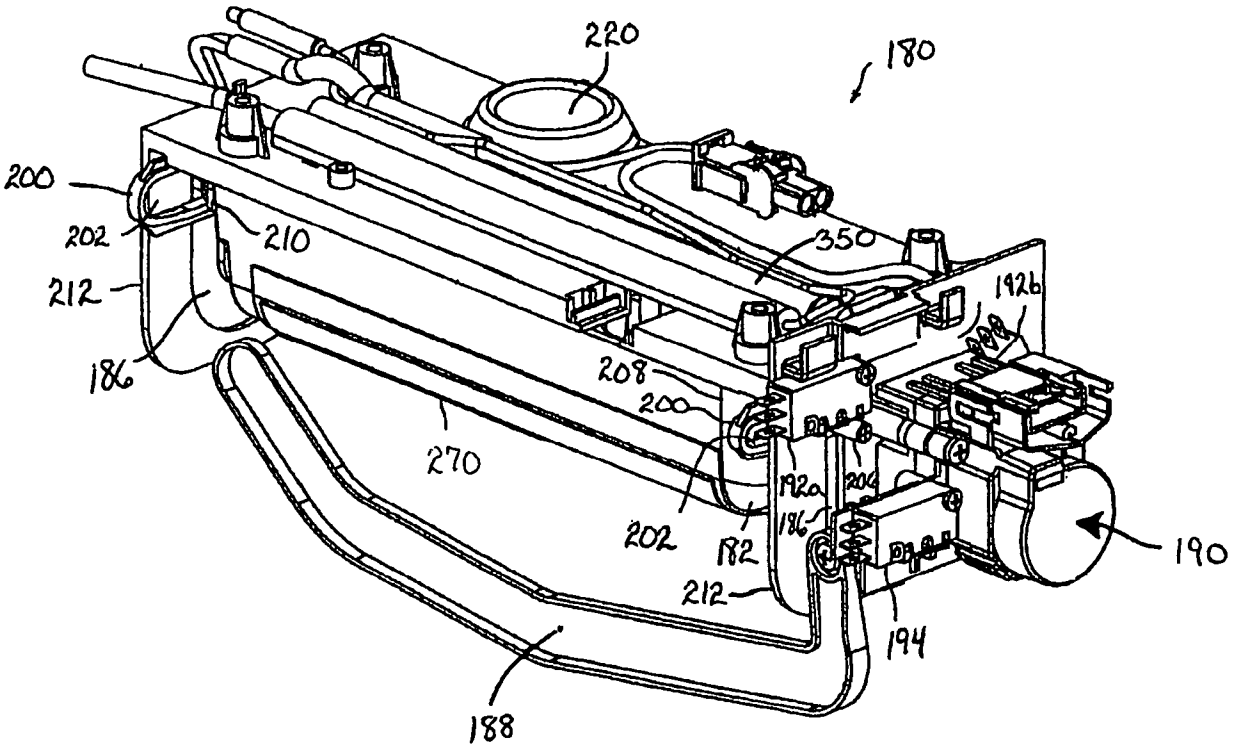
FIG. 11 shows a perspective view of an ice making assembly according to an embodiment of the invention.
Figure 12:
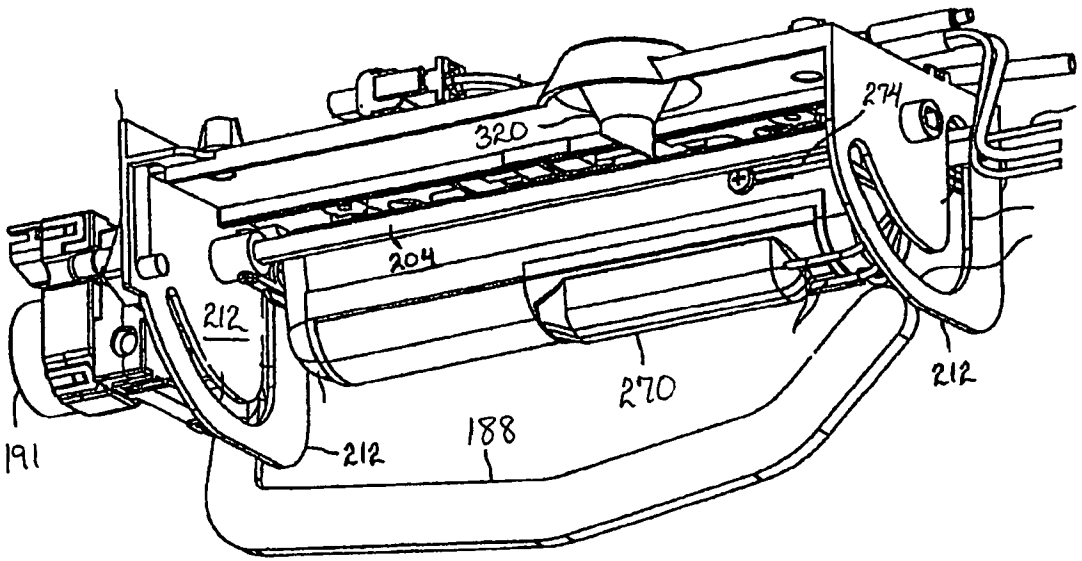
FIG. 12 shows another perspective view of the ice making assembly shown in FIG. 11.

FIG. 11 shows a perspective view of an embodiment of the ice making assembly 180 apart from the ice maker 20. The mold 182 is coupled to the ice making assembly 180 by a pair of drive arms 200 each defining an elongated groove 202. At least one of the drive arms 200 is operatively coupled to be pivoted about a drive shaft 204 (FIG. 12). A pin 206 protrudes from each of a proximate end 208 and a distal end 210 of the mold. Each pin 206 extends at least partially through one of the elongated grooves 202 of the drive arms 200 and a track 186 formed in opposing brackets 212 located at opposite ends of the mold 182. A water inlet port 220 through which water is introduced into the mold 182 in the water-fill position is exposed atop the ice making assembly 180.

Figure 14:
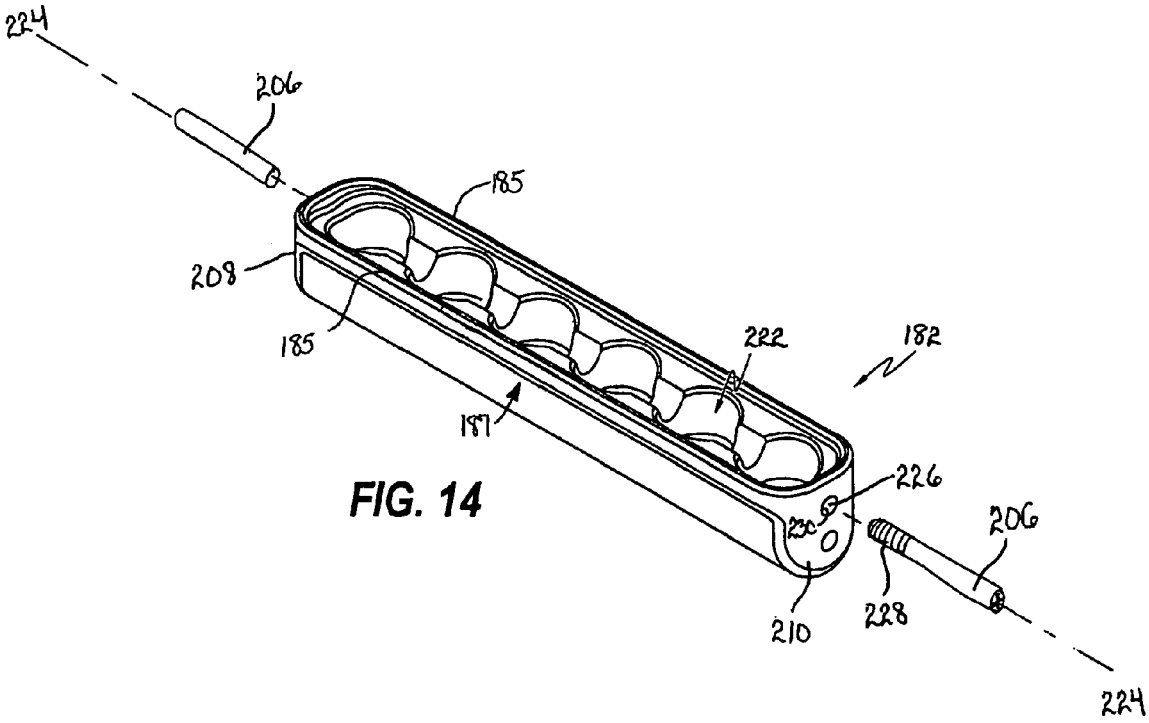
FIG. 14 shows a perspective view of a mold including cavities for receiving water to be frozen into ice pieces.

An exploded view illustrating an embodiment of the mold 182 and pins 206 is shown in FIG. 14. The mold 182 according to the present embodiment includes a plurality of individual cavities 222 in which water is to be frozen into individual ice pieces. The cavities 222 are arranged in a linear pattern generally along longitudinal axis 224. Each pin 206 has an outside dimension sized to approximate the inside dimension of a receiver 226 formed in each of the proximate and distal ends 208, 210 of the mold 182. At least one of the pins 206 includes an externally-threaded segment 228 for threadedly engaging a compatible internally-threaded segment 230 provided to an interior surface of at least one of the receivers 226. To remove the mold 182 from the drive arms 200, the pin 206 including the externally threaded segment 228 can be engaged by a screwdriver at an exposed end or other suitable tool to rotate the pin 206 in a counterclockwise direction, causing cooperation between the threaded segments 228, 230 to remove the pin 206 from the receiver 226. With the one pin 206 removed, the mold 182 can be pulled away from the drive arm 200 through which the remaining pin 206 extends until that remaining pin 206 is free of the drive arm 200.

An alternate embodiment of the mold 182 is shown in FIGS. 6-19. Similar to the previous embodiments, and as described in more detail below, the mold of 182 can include electrical components such as a heating element 270, a sensor such as a thermistor 272 (FIG. 20) embedded within a recess 271 formed in the mold 182, for example, for monitoring a temperature of the ice mold 182, a ground connection 274 for grounding the metallic mold 182, and other electric features that can be utilized in controlling and/or monitoring operation of portions of the ice making assembly 180. The pin 206 described with reference to FIG. 14 that included the threaded segment 228 could optionally define a longitudinal interior passage through which wires 276 (FIG. 16) provided to conduct signals to and from such electric features could be routed to avoid entanglement.

According to an alternate embodiment shown in FIGS. 16-19, the electric signal carrying wires 276 connected to the heating element 270 are drawn out to the side from the mold 182. The wires 276 are drawn out from mold 182 so as to pass through an interior passage 275 defined by the pin 206*a* according to the present embodiment. A thermistor 272 (FIG. 20) for detecting a temperature of the mold 182 and a connecting wire 279 connected to the thermistor 272 is drawn out together with the connecting wires 277 for supplying electric power to the heating element 270, and a connecting wire 280 for grounding the mold 182 and/or heating element 270 is coupled to the mold 182. The connecting wires extending through the interior passage are also collectively referred to herein generally as wires 276.

The pin 206*a* includes a first engaging tube piece 281 and a second engaging tube piece 282 which are engaging projection pieces divided by a face parallel in the right and left direction, i.e., in an axial direction of the pin 206*a*. In this embodiment, a dividing face of the pin 206*a* includes an abutting faces of the first engaging tube piece 281 and the second engaging tube piece 282. In other words, the dividing face of the pin 206*a* is substantially parallel to the horizontal plane. Further, the dividing face of the pin 206*a* is formed on a plane passing an axial center of the pin 206*a*. The pin 206*a* is substantially bisected into two engaging tube pieces, i.e., into the first engaging tube piece 281 and the second engaging tube piece 282, and the first engaging tube piece 281 and the second engaging tube piece 282 are formed in a roughly half-cylindrical shape.

Figure 16:
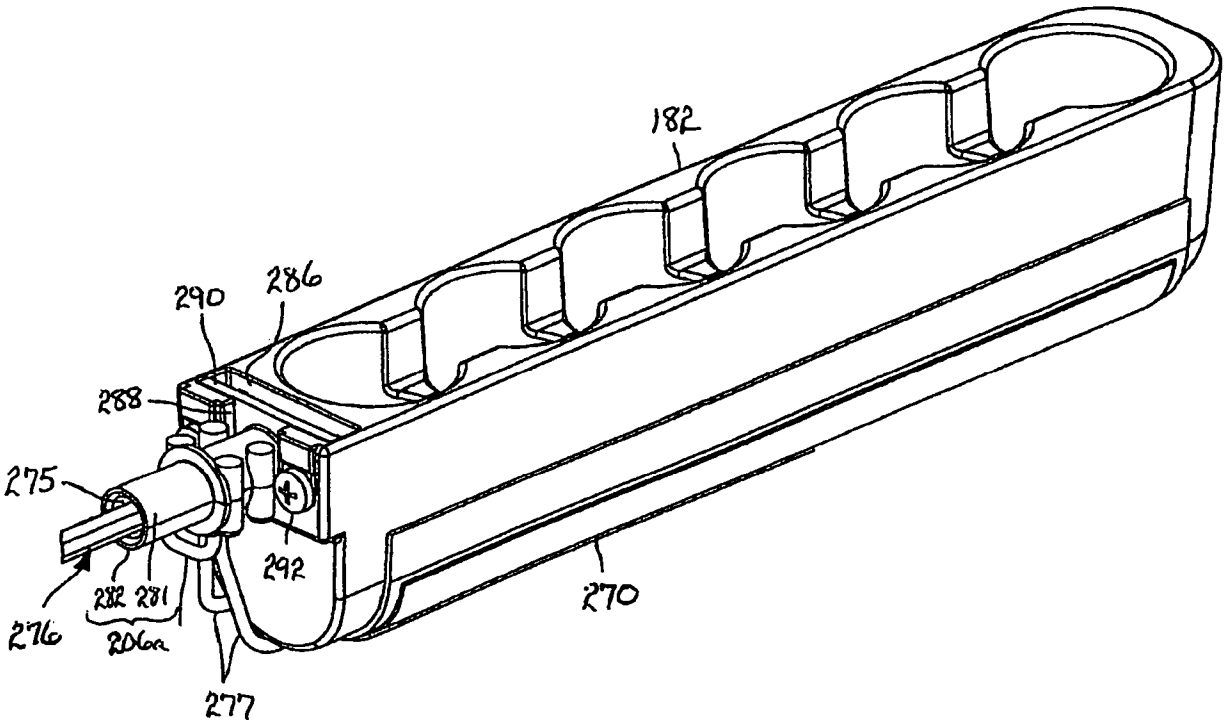
FIG. 16 shows a perspective view of an embodiment of a mold to be provided to an ice making assembly, the mold including a hollow pin through which electrical wires can extend to conduct electric energy to electric features provided to the mold.

The first engaging tube piece 281 and the second engaging tube piece 282 are fixed to each other with screws 284. In this embodiment, as shown in FIG. 16 and the like, the first engaging tube piece 281 is disposed on the upper side and the second engaging tube piece 282 is disposed on the lower side.

Figure 18:
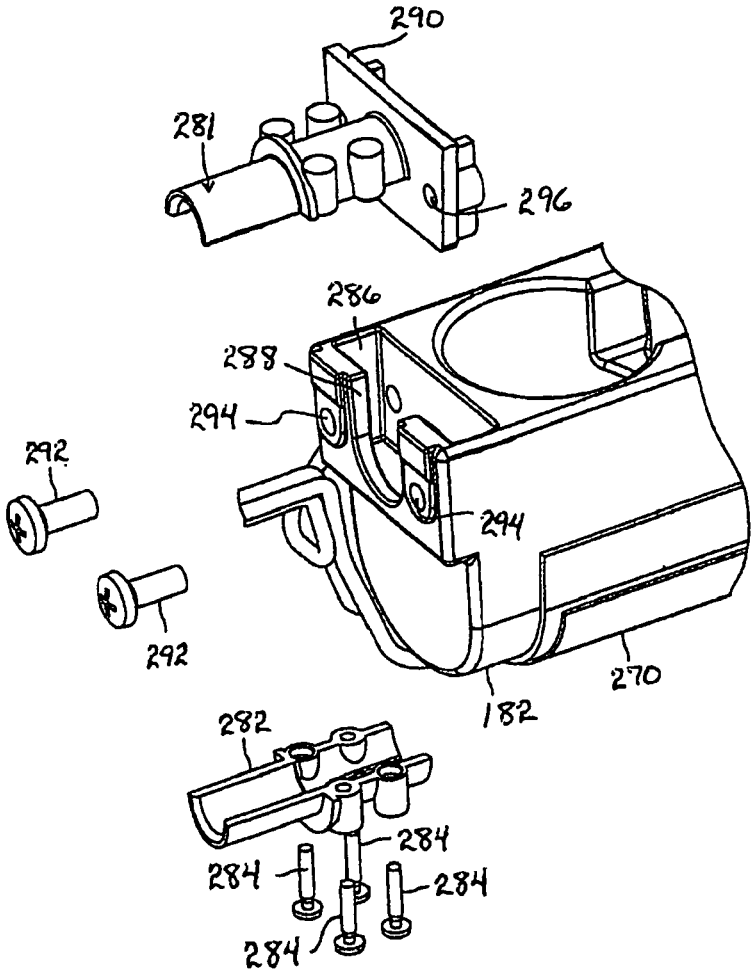
FIG. 18 shows a partial exploded view of the hollow pin shown in FIGS. 16 and 17.

As shown in FIG. 18, a recessed part 286 for fixing the first engaging tube piece 281 is formed in an upper face of the left side end of the mold 182. Further, the mold 182 is formed with an arrangement hole 288 whose bottom part is formed in a semicircular shape that is similar to an external surface of the second engaging tube pieced 282.

A flange shaped plate part 290 to be inserted within the recessed part 286 when the pin 206*a* is coupled to the mold 182 is formed at the right-side end of the first engaging tube piece 281. The pin 206*a* is to be coupled to the mold with screws 292 in a state where the plate part 290 is disposed within the recessed part 286 and the cylindrical portion of the pin 206*a* is disposed within the arrangement hole 288. The plate part 290 is generally perpendicular to the cylindrical portion of the pin 206*a*, and includes screw holes 296 therein for receiving the screws 929 that also extend into apertures 294 formed in the mold 182.

Figure 17:
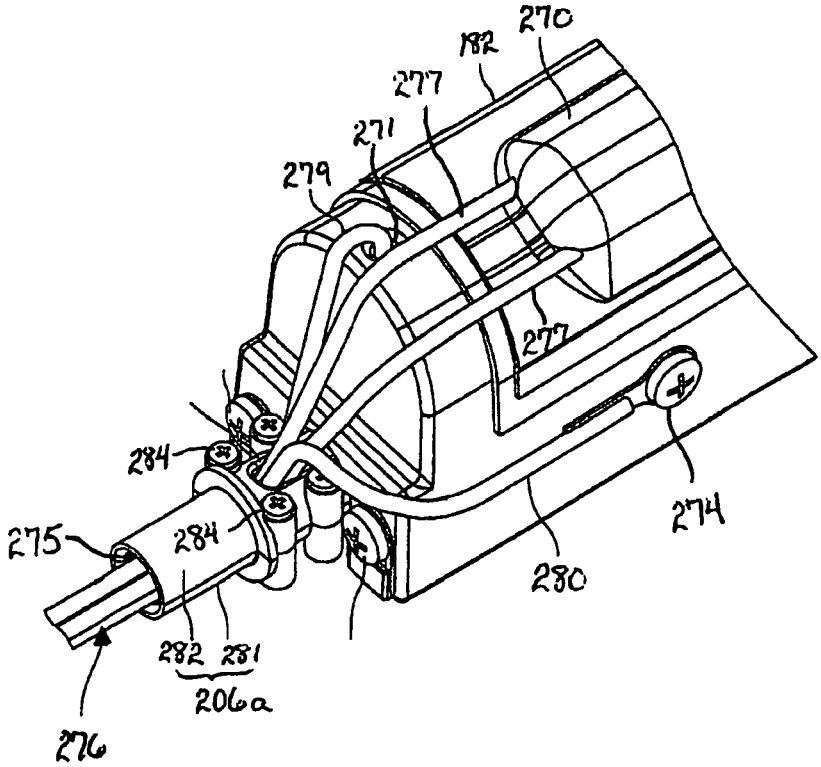
FIG. 17 shows a bottom view looking up at the underside of an end of the mold shown in FIG. 16 provided with a hollow pin.
Figure 19:
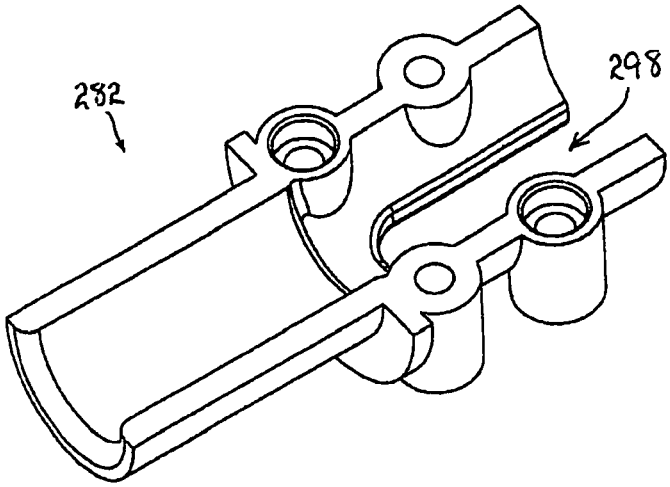
FIG. 19 shows a portion of the hollow pin shown in FIGS. 16-18.

As shown in FIG. 19, the second engaging tube piece 282 can also include an aperture groove 298 having a substantially U shape opening towards an end to be secured against the mold 182. Wires 276 extending through the interior passage 275 of the pin 206*a* can drop down through the aperture groove 298 to reach their respective electric feature on the mold 182, as shown in FIGS. 16 and 17.

Embodiments of the present invention include a mold 182 that can be adjusted along a path that is not concentric about a central axis of the drive shaft 204 during adjustment between water-fill and ice-making positions of the mold 182. Although the drive shaft 204 rotates about a central axis 240, illustrated in FIG. 15B as a dot representing a line extending perpendicularly into the page, the mold 182 does not also rotate concentrically about the central axis 24. Instead, a radial distance of the mold 182 from the central axis 240 (and the drive shaft 204) varies during adjustment of the mold 182 between the water-fill and ice-making positions. In other words, the mold 182 does not travel about the drive shaft 204 in an arcuate path having a fixed radius of curvature. As the mold 182 is adjusted by the driver 190 between the water-fill position and the ice-making position, the pins 206 protruding from the mold 182 into the elongated grooves 202 of the drive arms 200 are guided along the path defined by the tracks 186 formed in the opposing brackets 212. The pins 206 are allowed to travel in a radial direction relative to the central axis 240 within the elongated grooves 202.

For example, FIG. 15A offers a side view of an illustrative embodiment of a drive arm 200, and FIG. 15B provides a view beneficial for illustrating the cooperation of a pin 206, an elongated groove 202 defined by a drive arm 200, and a track 186 defined by one of the opposing brackets 212. The description of the embodiment shown in FIG. 15B makes reference to the structure at one end of the mold 182 but is equally applicable to the structure disposed at the other end of the mold 182.

As described above and shown in FIG. 15A, the drive arm 200 is formed with the elongated groove 202. In this embodiment, a lower side face 246 adjacent a distal end 248 of the elongated groove 202 is inclined by the angle "$\alpha$" with respect to a lower side face 250 adjacent a proximate end 252 of the elongated groove 202. In other words, the lower side face 246 adjacent the distal end 248 of the elongated groove 202 in FIG. 15A is gradually inclined upward toward the distal end 248.

With reference to FIG. 15B, one end of at least one of the guide arms 200 is coupled to the drive shaft 204 to be rotated about central axis 240. Both ends of the drive shaft 204 are pivotally supported by the opposing brackets 212 as shown in FIG. 12, and as the drive shaft 204 is rotated about the central axis 240 drive arms 200 are also rotated with the drive shaft 204 as its center. For the embodiment shown in FIG. 12, the two drive arms 200 are disposed on inner sides of the opposing brackets 212 and are disposed outside of the ends 208, 210 of the mold 182. When the drive arms 200 are turned with the drive shaft 204 as its turning center, each pin 206 extending through its respective elongated groove 202 travels along the track 186 formed in each opposing bracket 212.

As shown in FIG. 15B, the inclined lower side face 246 of the elongated groove 202 is abutted against the pin 206, which is also in contact with an outer boundary surface 254 of the track 186. As the drive shaft 204, and accordingly the drive arm 200 is rotated in a clockwise direction indicated by arrow 256 with the central axis 240 as its center in FIG. 15B, the pin 206 will gradually travel along the outer boundary surface 254 of the elongated groove 202. As the pin 206 travels along the substantially vertical segment 258 of the outer boundary surface 254 and the drive arm 200 continues to rotate in the direction of arrow 256, the pin 206 will also travel in a radial inward direction, generally toward the proximate end 252 of the elongated groove 202 and drive shaft 204 in the direction indicated by arrow 260 in FIGS. 15A and 15B.

Figure 20:
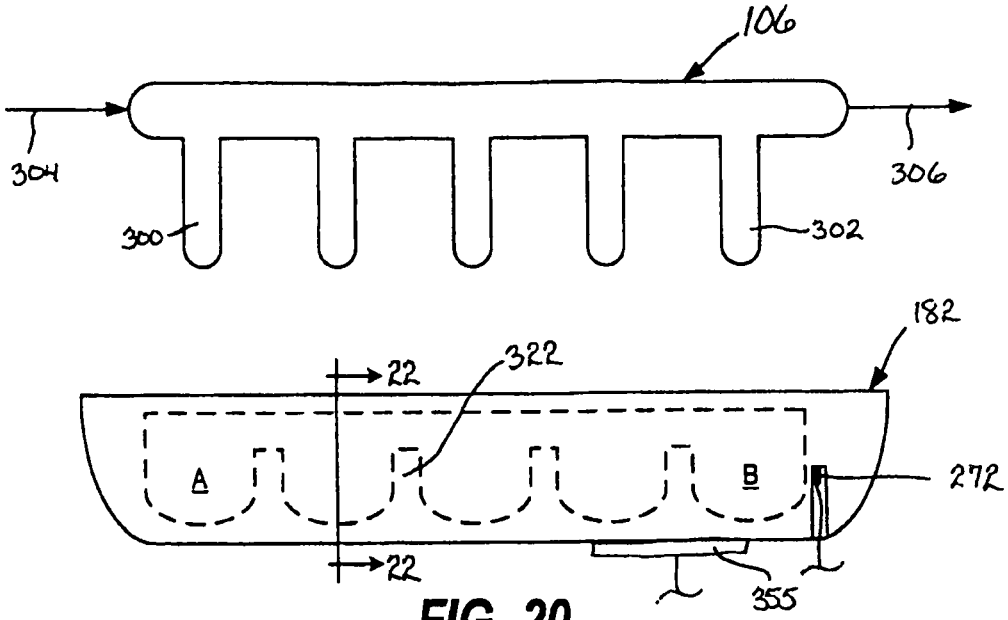
FIG. 20 shows a side view of an embodiment of an ice maker evaporator disposed vertically above a mold.

FIG. 20 illustrates an embodiment of a relationship between the mold 182 and the ice maker evaporator 106 that is to be filed with water to be frozen into ice pieces. According to the present embodiment, the mold 182 includes a plurality of linearly-aligned cavities 222 defined in FIG. 20 by hidden lines. First cavity A receives a finger 300 protruding from the ice maker evaporator 106 adjacent an inlet through which the refrigerant enters the ice maker evaporator 106 when the mold 182 is in the ice making position. Also when the mold 182 is in the ice making position, a second cavity B is positioned to receive a finger 302 that protrudes from the ice maker evaporator 106 adjacent an outlet through which the refrigerant exits the ice maker evaporator 106. Refrigerant entering the ice maker evaporator 106 is represented by arrow 304 and refrigerant exiting the ice maker evaporator 106 is represented by arrow 306. The finger 300 is exposed to fresh refrigerant as it enters the ice maker evaporator 106 and before the finger 302 is exposed to the refrigerant. And since the refrigerant subsequently reaching the portion of the ice maker evaporator 106 adjacent finger 302 is partially evaporated after having entered the ice maker evaporator 106 adjacent finger 300, the external surface of the finger 300 can reach a temperature below 0° C. before the external surface of the finger 302. Accordingly, the water in the first cavity A can be expected to freeze into an ice piece before the water in the second cavity B, and the temperature of the mold 182 itself at the perimeter of cavity A can also be expected to fall below a predetermined temperature, such as 0° C. for example, before the mold 182 at the perimeter of cavity B.

As mentioned above with reference to FIG. 17, a thermistor 272 or other suitable temperature sensor operatively coupled to the controller 111 is embedded in the recess 271 formed in the mold 182 immediately adjacent the perimeter of cavity B. Upon receiving a signal transmitted by the thermistor 272 indicative of a predetermined temperature, the controller 111 can conclude by executing computer-executable instructions that the temperature of the mold 182 in the vicinity of cavity A has already fallen to that predetermined temperature. The signals from the thermistor 272 can be transmitted to the controller 111 to control ice making operations as explained in detail below.

Figure 21:
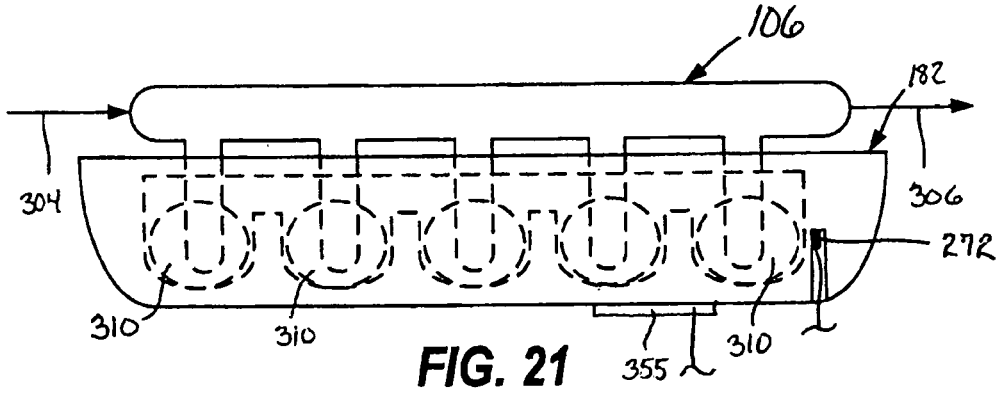
FIG. 21 shows a side view of the mold in FIG. 20 elevated to at least partially receive fingers extending from the ice maker evaporator during an ice making cycle.

FIG. 21 illustrates an embodiment of the mold 182 in the ice-making position. Positioned as such, the mold 182 has been elevated such that each of the fingers 300, 302 protruding from the ice maker evaporator 106 has been received within their respective cavities A, B. To elevate the mold 182 upward so the fingers 300, 302 each extend at least partially into their respective cavities A, B, the drive arms 200 shown in FIG. 15B are rotated in the direction of arrow 256 (the clockwise direction in FIG. 15B) about the central axis 240 with the drive shaft 204 at their center. As the pin 206 travels along the substantially vertical segment 258 the mold 182 is elevated substantially vertically to receive the fingers 300, 302 in their respective cavities A, B. As the mold 182 reaches its uppermost travel limit, a substantially-planar, horizontal top surface of the mold 182, the top 185 (FIG. 14) of laterally opposing side walls 187 of the mold 182, or any other surface that is substantially horizontal can optionally come into contact with a plurality of leveling ribs 314, shown in FIG. 13A. The leveling ribs 314 are substantially horizontal protrusions that extend transversely across the mold 182 while it is in the ice-making position. When the top 185 of each laterally opposing side wall 187 comes into contact with the leveling ribs 314, for example, the mold 182 is biased towards an upright orientation such that the water in the mold 182 does not spill out of the mold 182. Further, with the mold 182 in the upright orientation established by the leveling ribs 314, the fingers 300, 302 extend substantially parallel with a central axis extending concentrically out of the respective cavities A, B.

As the refrigerant expands within the ice maker evaporator 106 the latent heat of vaporization required for the change of phase is drawn, at least in part, through the external surface of the fingers 300, 302, thereby reducing the temperature of the external surface of those fingers 300, 302. The water in the cavities A, B freezes to the external surface of the fingers 300, 302, respectively, and the freezing process continues to form ice pieces 310 from the inside out.

Figure 13A:
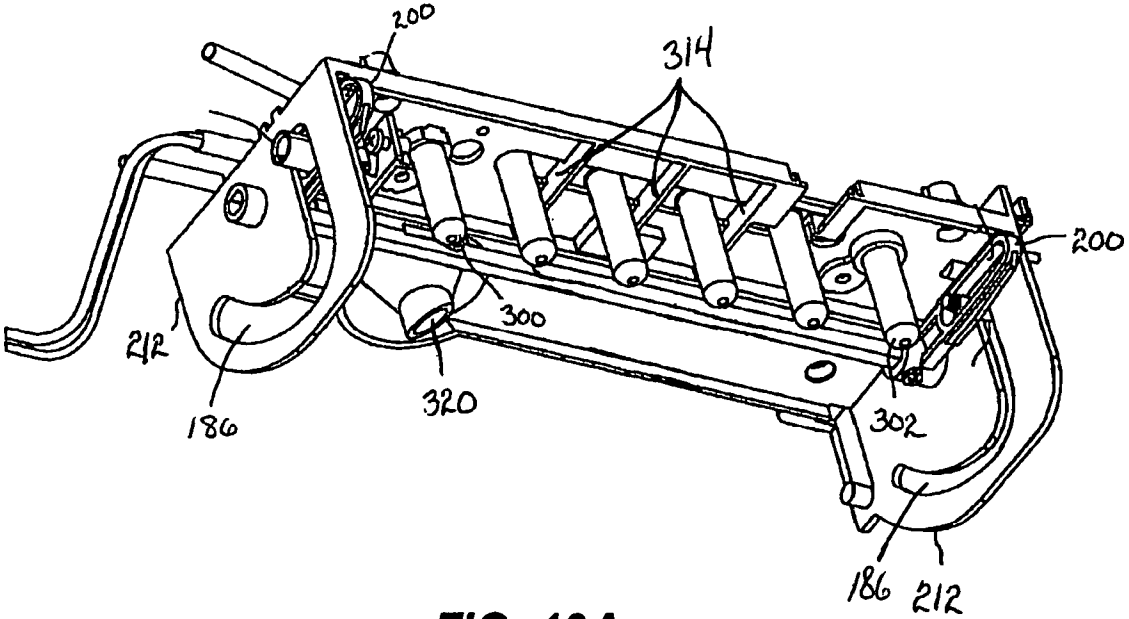
FIG. 13A shows a bottom view looking up at an underside of an ice maker evaporator including fingers provided to an ice making assembly.

In the water-fill position, the mold 182 is positioned with a pin 206 disposed adjacent an end 316 of the track 186 in FIG. 13A opposite an end 318 at which the pin 206 was located when the mold 182 was in the ice-making position. In the water-fill position, the mold 182 is disposed vertically beneath a water discharge 320. Water introduced to the ice maker 20 through the water inlet port 220 (FIG. 11) exits through the water discharge 320 and is fed into the mold 182.

Figure 22:
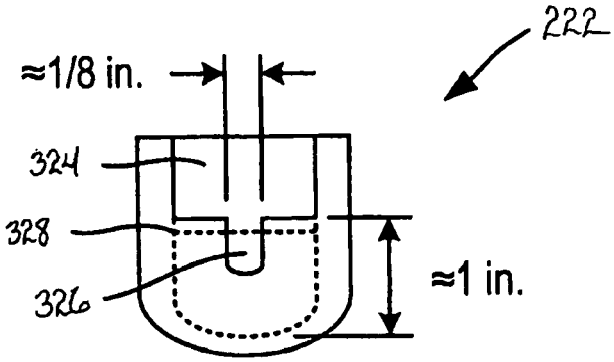
FIG. 22 shows a cross-sectional view of a cavity formed in the mold taken along line 22-22 in FIG. 20.

The water fed into the mold 182 can be poured directly into a single cavity 222 defined by the mold 182 and allowed to cascade into the other cavities 222 due to the configuration of partitions 322 (FIG. 20) separating each of the cavities 222 from adjacent cavities 222. A cross-section of an embodiment of a mold 182 illustrating the configuration of the partitions 322 is shown in FIG. 22. As shown, the partition 322 includes a wide cutout section 324 adjacent a top of the cavities 222 that enlarges the available passageway through which water from the water discharge 320 can rapidly flow from one cavity 222 to the immediately adjacent cavity 222. Each partition 322 also includes a narrow channel 326 formed therein to allow the water level 328 (represented by dashed lines) to be approximately equal in each receptacle cavity 222. For the present embodiment the width of the narrow channel 326 is about ⅛ inch wide, and is small enough to allow the ice pieces to break apart when they are dropped into the ice bin 35 from the ice maker evaporator 106, such as fingers 300, 302 for example, to which they freeze. Total fill time required to fill about six (6) linearly arranged cavities 222 to approximately the same water depth (which in the present embodiment is about one (1) inch) is about four (4) seconds, but alternate embodiments can take longer or shorter depending on factors such as number of cavities 222 to be filled, water flow rate, depth of cavities 222, dimensions of the wide cutout section 324 and narrow channel 326, etc. . . .

Figure 13B:
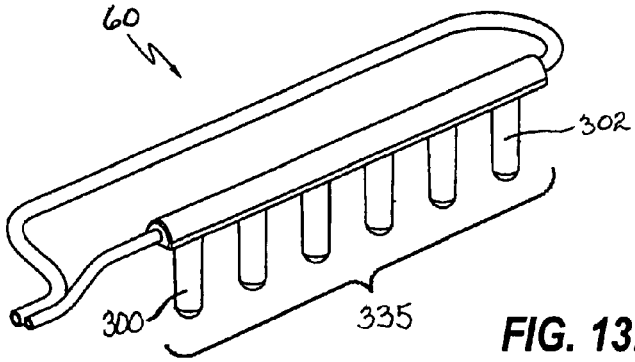
FIG. 13B shows a perspective view of an embodiment of an ice maker evaporator including fingers to which ice pieces freeze.

FIG. 13B shows an illustrative embodiment of the ice maker evaporator 106 apart from the ice making assembly 180. As shown, the ice maker evaporator 106 includes an expansion chamber 330 in thermal communication with a plurality of protruding fingers, indicated collectively at 335. Refrigerant delivered to the ice maker evaporator 106 by the ice maker capillary tube 104 enters the expansion chamber 330 adjacent the finger 300 to be received within the first cavity A (FIG. 20) of the mold 182. The expansion chamber 330 has a larger inside diameter than the ice maker capillary tube 104, thereby dropping the pressure of the refrigerant as it enters the expansion chamber 330 and allowing it to at least partially evaporate and draw thermal energy from the ambient environment through the fingers 335. By absorbing the thermal energy, including the latent heat of vaporization through the fingers 335 the temperature of the fingers' externally exposed surface drops below 0° C., causing the water in which the fingers 335 are submerged to freeze to the fingers' external surface.

The external surface of the fingers 335 can also be heated according to alternate embodiments by supplying the high-pressure, high-temperature gas output by the compressor 94 (FIG. 7A) to the ice maker evaporator 106 through a bypass line (not shown), bypassing the condenser 96 and electronic expansion valve 110. According to alternate embodiments, the ice maker evaporator 106 includes an electric heating element 350 (FIGS. 7A and 11) that can emit heat to be transmitted to the fingers 335, thereby elevating the temperature of the external surface of the fingers 335 and releasing the ice pieces 310 frozen to the fingers 335. The heating element 350 can be embodied as hot gas from the compressor 94 that bypassed the condenser 96 (FIG. 7A), a resistive electric heating element, or any other suitable source of heat.

Figure 23A:
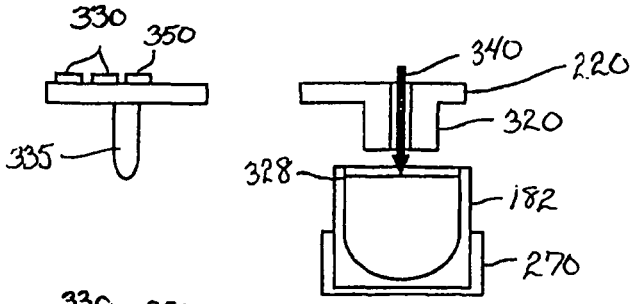
FIGS. 23A-23E graphically depict relative positions and operational states of portions of the ice making assembly during an ice making cycle.

The steps involved in making ice according to one embodiment can be understood with reference to FIGS. 23A-23E. An end view of the fingers 335 and water discharge 320 are shown schematically in FIGS. 23A-23E, laterally aligned with each other in a manner similar to their alignment in FIG. 13A. In FIG. 23A, the ice making cycle begins with the mold 182 in the water-fill position, which is vertically beneath a water discharge 320. Water 340 is introduced into one of the cavities 222 and allowed to cascade into the other cavities through the wide cutout section 324 (FIG. 22) and narrow channel 326 separating the cavities 222. A desired water level can be established in the mold 182 by monitoring the water level 328 (FIG. 22) as it rises with a capacitive, inductive, optical, RF, physical, or other suitable water level sensor, by discontinuing the flow of water in to the mold 182 after a predetermined period of time has elapsed as determined by a timing circuit communicating with the controller 111, or in any other suitable manner.

Figure 23B:
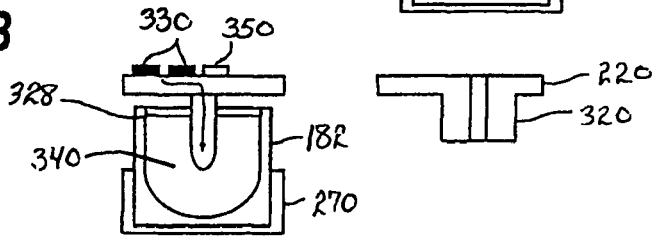

Once the water level 328 reaches the desired level in the mold 182 the controller 111 (FIG. 7A) initiates the transition of the mold 182 from the water-fill position shown in FIG. 23A toward the ice-making position shown in FIG. 23B. To move the mold 182 the controller 111 activates the motor 191 to cause rotation of the drive arms 200 in the direction of arrow 256 in FIG. 15B which, in turn, urges the pin 206 to travel along the track 186 that is defined by each of the brackets 212 (FIG. 13A). As the pin 206 makes the transition to the substantially vertical segment 258 of the track 186 the mold 182 is elevated substantially vertically to receive at least a portion of the fingers 335 within their respective cavities 222 and submerge the portion of the fingers 335 in the water therein. The mold 182 is elevated until an upper portion such as the top 185 (FIG. 14) of laterally opposing side walls 187 of the mold 182 reaches the leveling ribs 314, at which time any significant deviation of the mold 182 from the upright orientation can be minimized to avoid spilling the water 340 from the mold 182 and promote the formation of ice pieces 310 having a generally uniform shape.

With the mold 182 in the ice making position of FIG. 23B the controller 111 can adjust the electronic expansion valve 110 (FIG. 7A) to control the introduction of refrigerant to the ice maker evaporator 106. In FIG. 23B schematic depiction of the expansion chamber 330 of the ice maker evaporator 106 is shaded to indicate that the ice maker evaporator 106 is in an active state. In the active state, refrigerant is being supplied to the ice maker evaporator 106 to cool the fingers 335 to a temperature below 0° C. and freeze the water 340 to the surface of the fingers 335. Further, the controller 111 activates the compressor 94 (FIG. 7A) if it is not already actively running and prevents deactivation of the compressor 94 while the ice maker evaporator 106 is in the active state to ensure a ready supply of refrigerant to the ice maker evaporator 106 while the ice maker evaporator 106 is in the active state.

Figure 23C:
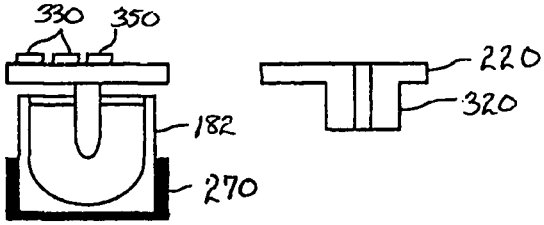

As discussed above with reference to FIGS. 21 and 22, during the active state of the ice maker evaporator 106 the refrigerant is introduced to the ice maker evaporator 106 adjacent to the finger 300 partially inserted into cavity A, and exits the ice maker evaporator 106 adjacent to the finger 302 partially inserted into cavity B. Thus, the water 340 in cavity A can be expected to be frozen into a fully formed ice piece 310 by the time the water 340 in cavity B is frozen into a fully formed ice piece 310. When the thermistor 272 (FIGS. 20 and 21) senses a predetermined temperature of the mold 182 adjacent to cavity B, the controller 111 can respond based on the conclusion that the ice piece 310 on each finger 335 is fully formed. The electronic expansion valve 110 can be adjusted to limit, and optionally discontinue the supply of refrigerant to the ice maker evaporator 160, but the controller 111 allows the compressor 94 to continue operating, even in the absence of a demand for refrigerant by the System Path, to evacuate remaining refrigerant from the ice maker evaporator 160. The controller 111 activates the heating element 270 provided to the mold 182 to partially melt the ice pieces 310 and separate them from the mold 182. The ice maker evaporator 160 returned to the inactive state (i.e., after interruption of the supply of refrigerant to the ice maker evaporator 160) and the heating element 270 in the active state (represented by the shading of heating element 270) are shown in FIG. 23C.

Figure 23D:
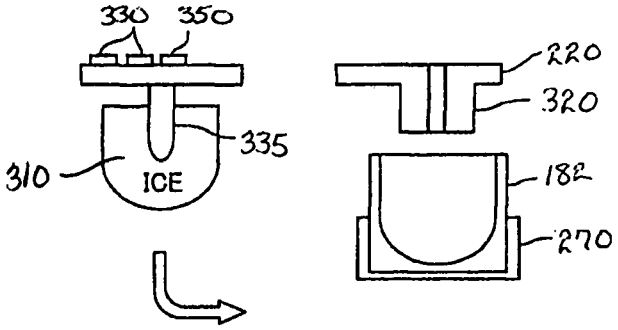

After the heating element 270 has been activated the thermistor 272 continues to monitor the temperature of the mold 182 adjacent cavity B (FIGS. 20 and 21). Once the thermistor 272 senses the mold 182 has reached a predetermined temperature above the temperature at which the heating element 270 was activated and sends a signal to the controller 111, the controller 111 can deactivate the heating element 270 and initiate the motor 191 (FIGS. 10A-10C) to transport the mold 182 back towards the water-fill position as shown in FIG. 23D. The interface between each ice piece 310 and the mold 182 has sufficiently melted to permit separate of the mold 182 from the ice pieces 310 under the force imparted by the motor 191.

If the controller 111 detects that the motor 191 can not pull the mold 182 away from the fingers 335 and return to the water-fill position as required to harvest newly-formed ice pieces 310, the controller 111 will conclude that the mold 182 is still frozen to one or more of the ice pieces frozen to the fingers 335. In response, the controller 111 will activate (or keep activated) only the heating element 270 provided to the mold 182 in an effort to break the mold 182 free from the ice pieces on the fingers 335, but leave the ice pieces 310 on the fingers 335. The operation of the heating element 350 to transmit heat to the fingers 335 will be delayed. The operation of the heating element 270 and the delay of the activation of the heating element 350 provided to the ice maker evaporator 106 can last a predetermined period of time, until the thermistor 272 detects another elevated temperature, or based on any other factor(s) that can indicate separate of the mold 182 from the ice pieces 310 on the fingers 335.

Operation of the motor 191 to return the mold 182 back to the water-fill position also elevates the bail arm 188 (FIGS. 10A and 10B) to be elevated at least partially out of the ice bin 35 as discussed above. With the bail arm at least partially elevated the ice pieces 310 can drop under the force of gravity into the ice bin 35 without contacting the bail arm 188 when the ice pieces 310 are released from the fingers 335.

Figure 23E:
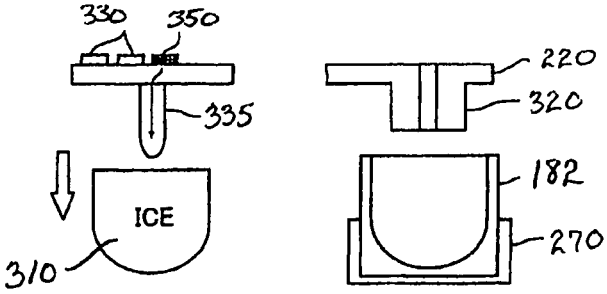

In the release step of FIG. 23E, the heating element 350 is activated (shown by the shading of heating element 350). At least a small portion of the ice pieces is melted by the elevated temperature of the fingers 335, allowing the ice pieces to fall from the fingers 335 into the ice bin 35. The ice making cycle can then begin again by introducing new water 340 into the mold 182 as shown in FIG. 23A, and moving the mold 182 back towards the ice making position. But as the mold 182 is being returned to the ice-making position the bail arm 188 can be lowered by operation of the motor 191 once again as described above. If the bail arm 188, upon being lowered contacts the recently formed ice pieces now in the ice bin 35 and the bail arm 188 can not extend a predetermined minimum distance into the ice bin 35, the ice making cycle currently underway can optionally be suspended with the mold 182 in the ice making position. The suspension of the ice making cycle can last until a sufficient number of ice pieces 310 are removed from the ice bin 35 to permit the bail arm 188 to extend beyond the minimum distance into the ice bin 35.

The ice pieces 310 within the ice bin 35 may accumulate and form an obstruction to the mold 182 traveling along its path between the water-fill and ice making positions. The controller 111 can be alerted to such a circumstance if the mold 182 has not reached its destination within a predetermined time limit, within a predetermined number of Hall effect pulses from the motor 191, or in the absence of a signal from a switch 192*a*, 192*b* indicating that the mold 182 has reached its destination, or any combination thereof. In an effort to clear such an obstruction, the controller 111 can activate the heating element 270 provided to the mold 182 to heat the metallic mold 182 and melt the ice pieces 310 forming the obstruction. The ice pieces 310 can be melted sufficiently to allow the mold 182, moving under the force of the motor 191, to push through the obstruction.

In other instances, the mold 182 may be unable to fully arrive at the ice-making position where the fingers 335 extend into the individual cavities 222 formed in the mold 182. Under either circumstance, the controller 111 can conclude based on a signal from an appropriate sensor (or the absence of a signal indicating the mold 182 has reached its destination) that there is an ice piece 310 that did not release still frozen to one or more of the fingers 335 and this remaining ice piece is preventing the mold 182 from reaching its destination, or that there is an ice piece from a previous cycle remaining in one or more of the cavities 222 of the mold 182, or both. In response, the controller 111 will activate both the heating element 350 for heating the fingers 335 and the heating element 270 provided to the mold 182 in an effort to clear the remaining ice piece 310 from the previous ice making cycle.

To provide redundant temperature control of the mold 182, the mold 182 can also optionally be provided with a backup temperature sensor 355 (FIGS. 20 and 21). The backup temperature sensor 355 can include any sensing device capable of transmitting a signal indicative of the mold's temperature to the controller 111. For example, a bi-metallic switch that is interrupted or closed at a desired temperature can be provided as the backup temperature sensor 355. The backup temperature sensor 355 can be utilized to detect a condition when the mold 182 reaches a temperature inappropriate at that point during the ice making cycle, such as when the heating element 270 is heating the mold 182 while the mold 182 is in the water-fill position. Further, a fuse or other circuit interrupter can be provided to deactivate any of the electric heating elements discussed herein.

Occasionally during operation of the refrigerator 10 the system evaporator 60 will accumulate frost thereon and require defrosting. During defrosting of the system evaporator 60 the compressor 94 is turned off (or locked in the off state if already off when a defrost cycle begins) to discontinue the supply of refrigerant to the system evaporator 60. The controller 111 (FIG. 7A) also activates the heating element 72 shown in FIG. 6 to generate heat and melt the frost accumulated on the system evaporator 60, including along the lateral sides of the system evaporator 60 where the ends 86 of the system evaporator's conduit (commonly referred to as a coil) carrying the refrigerant are exposed. However, since the compressor 94 also supplies the ice maker evaporator 106 and chamber evaporator 108 with refrigerant, the compressor 94 can not be turned off during an ice making cycle already underway or remain off if an ice making cycle is to be started. Thus, to coordinate defrosting of the system evaporator 60 and operation of the ice maker 20 the following control routine can be employed.

An ice making flag is set in the microcontroller 112 provided to the controller 111 to indicate that an ice making cycle is underway, and that the ice maker evaporator 106 requires refrigerant to be supplied by the compressor 94. If a call to defrost the main system evaporator 22 is issued based on a temperature sensed by a sensor within the fresh food compartment 14, freezer compartment 12, or at any other location of the refrigerator 10 while the ice making flag is set the microcontroller 112 will delay initiation of the requested defrost cycle until the ice making flag is no longer set, meaning that the ice making cycle that was underway has been completed. Once the ice making flag has been cleared the controller 111 can initiate defrosting of the system evaporator 60 and deactivate the compressor 94.

The amount of time that the defrost cycle can be delayed can be limited to a predetermined length of time. For example, a typical ice making cycle takes about 24 minutes to complete. If, after about 75 minutes (3× the length of the typical ice making cycle) from the time when the defrost cycle is requested the ice making flag remains set, the microcontroller 112 can be operated based on an assumption that an abnormal situation exists and terminate the ice making cycle to initiate an override defrost cycle. The microcontroller 112 clears the ice making flag in the process and allows the defrost cycle to proceed.

Once the ice making flag is cleared, whether by completion of the ice making cycle or by termination in response to an abnormal situation, a subsequent ice making cycle is delayed until the defrost cycle is complete and the compressor 94 can once again be activated.

To minimize the amount of water spilled within the ice maker 20 that could subsequently freeze, the controller 111 can initiate a Dry Cycle following an unexpected event. During a Dry Cycle the controller 111 initiates a new ice making routine from the beginning, except the step of filling the mold 182 with water 340 is omitted. Thus, should the unexpected even occur immediately following the filling of the mold 182 with water 340 (such as shown in FIG. 23A, for example), the controller 111 can initiate the remaining steps of the ice making cycle without causing the water to overflow from the mold 182 to subsequently freeze and accumulate within the ice maker 20. Examples of unexpected events that can cause a dry cycle to be carried out include, but are not limited to the loss of electric power to the refrigerator 10, a malfunction of the ice maker 20 or any portion thereof, and the occurrence of an override defrost of the system evaporator 60.

Figure 24:
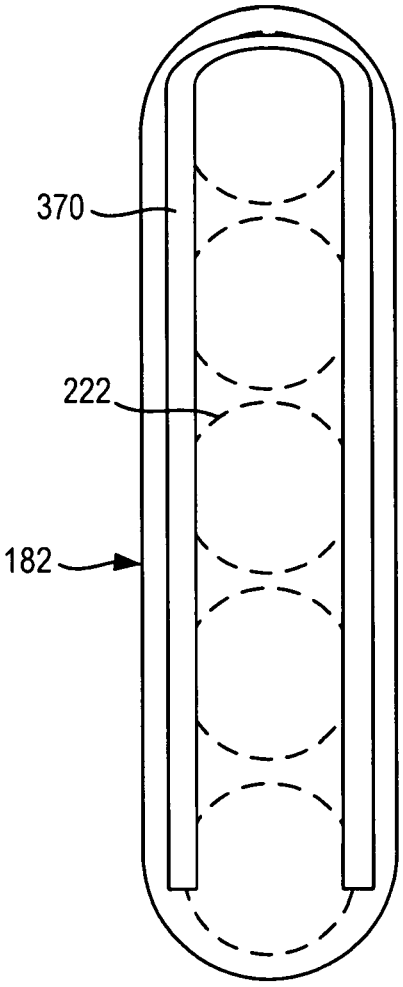
FIG. 24 shows a bottom view of a mold provided with a generally U-shaped heating element.

Embodiments of the heating element 270, such as the embodiment appearing in FIG. 12, can extend partially along a longitudinal axis of the mold 182, or can extend substantially along an entire length of the mold 182 to effectively release the ice pieces 310 from the mold 182. Other embodiments include a heating element 370 such as that depicted schematically in FIG. 24. According to such embodiments, the heating element 370 includes an elongated resistive element that can be installed within a generally U-shaped channel recessed into the mold 182. However, any suitably shaped heating element, including the heating elements 270, 370 discussed above can optionally be provided to transmit heat to the mold 182 to release the ice pieces 310 from the mold 182.

What is claimed is:

1. A refrigeration appliance comprising:

a fresh food compartment for storing food items in a refrigerated environment having a target temperature above zero degrees Centigrade;

one or more doors pivotally coupled to a cabinet of said refrigeration appliance for movement between a closed and an open condition to at least partially restrict and grant access to said fresh food compartment;

a freezer compartment disposed at an elevation vertically below said fresh food compartment for storing food items in a sub-freezing environment having a target temperature below zero degrees Centigrade;

a system evaporator that removes thermal energy from the freezer compartment to maintain the temperature therein at a temperature of 0° C. or less;

an ice chamber;

an ice maker disposed within the ice chamber, comprising an ice bucket, secured within said fresh food compartment at a location spaced apart from said one or more doors for freezing water into ice pieces, said ice bucket configured for storing said ice pieces produced by said ice maker; and a refrigeration system provided to said refrigeration appliance comprising:

an ice maker evaporator provided within the ice chamber for controlling a storage temperature to which ice pieces are exposed when stored in the ice bucket, said ice maker evaporator being separate from said system evaporator;

a cooling air duct disposed within the ice chamber, wherein at least a portion of said cooling air duct is adjacent to a lateral side of said ice bucket and extends from a rear of the ice maker towards a front of the ice maker along a longitudinal length of said ice bucket for delivering air cooled by said ice maker evaporator provided within the ice chamber to a temperature below zero degrees Centigrade to a region adjacent to said ice bucket, and an air mover provided within the ice chamber for blowing said air cooled by said dedicated ice maker evaporator through said cooling air duct to provide said cooling effect to said air provided to said ice maker; wherein said cooling air duct is located on one side of the ice maker and is defined between an outer plenum panel and a lateral side panel of the ice chamber that defines an interior boundary of the ice chamber and said cooling air duct is in communication with a plurality of vents formed in the lateral side panel that extend along said longitudinal length of said ice bucket and through which said cooled air from the ice maker evaporator and provided by the air mover is exhausted in a direction normal to said plurality of vents into said region adjacent to said ice bucket, and wherein at least one of said plurality of vents has a cross-sectional area that is different than a cross-sectional area of another of said plurality of vents, wherein the lateral side panel of the ice chamber further comprises an inward extending flange forming a surface on which the ice bucket can rest within the ice chamber, and the ice bucket comprises a compatible flange that rests on top of the inward extending flange of the lateral side panel.

2. The refrigeration appliance according to claim 1, wherein the cross-sectional area of each of said plurality of vents through which said cooling air is exhausted becomes progressively larger as said cooling air duct ends along said longitudinal length of said ice bucket.

3. The refrigeration appliance according to claim 2, wherein the diameter of each of said plurality of vents becomes progressively larger as said cooling air duct ends along said longitudinal length of said ice bucket.

4. The refrigeration appliance according to claim 1, wherein said plurality of vents is arranged to exhaust said cooled air at a plurality of locations along said longitudinal length of said ice bucket, wherein a cross-sectional area of a first vent is smaller than a cross-sectional area of a second vent located downstream of said first vent along a flow of said cooled air.

5. The refrigeration appliance according to claim 1, wherein each of said plurality of vents is adapted to exhaust said cooled air adjacent to a base of said ice bucket, wherein a volume of said cooled air exhausted through said vents is suitable to maintain a temperature of said ice pieces in said ice bucket at or below zero degrees Centigrade and allow a temperature vertically above said ice pieces to rise above zero degrees Centigrade.

6. The refrigeration appliance according to claim 1, wherein said ice maker evaporator comprises a first evaporator within said ice chamber for providing a cooling effect to air provided to said ice chamber and a separate second evaporator within said ice maker and dedicated for providing a cooling effect to water within an ice mold of the ice maker for producing said ice pieces, both of said first and second evaporators being separate from said system evaporator.

7. The refrigeration appliance according to claim 1, wherein said plurality of vents are disposed vertically below the inward extending flange.

8. The refrigeration appliance according to claim 1, wherein said cooled air from said ice maker evaporator that is exhausted from said plurality of vents provides a cooling effect to water within an ice mold of the ice maker sufficient to produce said ice pieces.

* * * * *